US009234655B2

(12) United States Patent
Progl et al.

(10) Patent No.: US 9,234,655 B2
(45) Date of Patent: Jan. 12, 2016

(54) LAMP WITH REMOTE LED LIGHT SOURCE AND HEAT DISSIPATING ELEMENTS

(75) Inventors: Curt Progl, Raleigh, NC (US); Praneet Athalye, Morrisville, NC (US); Gerald Negley, Chapel Hill, NC (US)

(73) Assignee: CREE, INC., Durham, NC (US)

( * ) Notice: Subject to any disclaimer, the term of this patent is extended or adjusted under 35 U.S.C. 154(b) by 366 days.

(21) Appl. No.: 13/607,300

(22) Filed: Sep. 7, 2012

(65) Prior Publication Data

US 2013/0113358 A1 May 9, 2013

Related U.S. Application Data

(63) Continuation-in-part of application No. 13/022,142, filed on Feb. 7, 2011, and a continuation-in-part of application No. 13/358,901, filed on Jan. 26, 2012.

(51) Int. Cl.
*F21V 29/00* (2015.01)
*F21K 99/00* (2010.01)
(Continued)

(52) U.S. Cl.
CPC ..... *F21V 29/004* (2013.01); *F21K 9/135* (2013.01); *F21V 3/04* (2013.01); *F21V 15/02* (2013.01); *F21V 29/006* (2013.01); *F21V 29/505* (2015.01); *F21V 29/77* (2015.01); *F21V 29/85* (2015.01); *F21V 29/86* (2015.01);
(Continued)

(58) Field of Classification Search
CPC ..... F21V 29/004; F21V 29/89; F21V 29/77; F21V 29/505; F21V 29/86
USPC ..... 362/273, 249.02, 294; 313/46
See application file for complete search history.

(56) References Cited

U.S. PATENT DOCUMENTS 2,394,992 A 2/1946 Franck ..... 362/311.12
3,143,592 A 8/1964 William ..... 174/16.3
(Continued)

FOREIGN PATENT DOCUMENTS

CN 1425117 6/2003
CN 1465106 A 12/2003
(Continued)

OTHER PUBLICATIONS

Office Action from U.S. Appl. No. 13/028,946, dated Jul. 16, 2012.
(Continued)

*Primary Examiner* — Joseph L Williams
(74) *Attorney, Agent, or Firm* — Koppel, Patrick, Heybl & Philpott

(57) ABSTRACT

LED based lamps and bulbs are disclosed that comprise an elevating element to arrange LEDs above the lamp or bulb base. The elevating element can at least partially comprise a thermally conductive material. A heat sink structure is included, with the elevating element thermally coupled to the heat sink structure. A diffuser can be arranged in relation to the LEDs so at least some light from the LEDs passes through the diffuser and is dispersed into the desired emission pattern. Some lamps and bulbs utilize a heat pipe for the elevating elements, with heat from the LEDs conducting through the heat pipe to the heat sink structure where it can dissipate in the ambient. The LED lamps can include other features to aid in thermal management and to produce the desired emission pattern, such as internal optically transmissive and thermally conductive materials, and heat sinks with different heat fin arrangements.

58 Claims, 7 Drawing Sheets

(51) Int. Cl.

| | |
|---|---|
| ***F21V 3/04*** | (2006.01) |
| ***F21V 15/02*** | (2006.01) |
| ***F21V 29/505*** | (2015.01) |
| ***F21V 29/77*** | (2015.01) |
| ***F21V 29/85*** | (2015.01) |
| ***F21V 29/87*** | (2015.01) |
| ***F21V 29/89*** | (2015.01) |
| *F21Y 101/02* | (2006.01) |
| *F21V 29/506* | (2015.01) |
| *F21V 29/58* | (2015.01) |

(52) U.S. Cl.

CPC ..... *F21V 29/87* (2015.01); *F21V 29/89* (2015.01); *F21V 29/506* (2015.01); *F21V 29/58* (2015.01); *F21Y 2101/02* (2013.01)

(56) References Cited

U.S. PATENT DOCUMENTS

| | | | | |
|---|---|---|---|---|
| 3,581,162 | A | 5/1971 | Wheatley | 317/234 |
| 4,204,246 | A | 5/1980 | Arii et al. | 361/699 |
| 4,727,289 | A | 2/1988 | Uchida | |
| 5,140,220 | A | 8/1992 | Hasegawa | |
| 5,463,280 | A | 10/1995 | Johnson | |
| 5,519,596 | A | 5/1996 | Woolverton | |
| 5,535,230 | A | 7/1996 | Abe | |
| 5,561,346 | A | 10/1996 | Byrne | 313/512 |
| 5,581,683 | A | 12/1996 | Bertignoll et al. | |
| 5,585,783 | A | 12/1996 | Hall | |
| 5,655,830 | A | 8/1997 | Ruskouski | |
| 5,688,042 | A | 11/1997 | Madadi et al. | |
| 5,806,965 | A | 9/1998 | Deese | 362/249 |
| 5,838,101 | A | 11/1998 | Pappalardo | 313/487 |
| 5,850,126 | A | 12/1998 | Kanbar | |
| 5,890,794 | A | 4/1999 | Abtahi et al. | |
| 5,931,570 | A | 8/1999 | Yamuro | |
| 5,934,798 | A | 8/1999 | Roller et al. | 362/497 |
| 5,947,588 | A | 9/1999 | Huang | |
| 5,949,347 | A | 9/1999 | Wu | |
| 5,956,106 | A | 9/1999 | Petersen | |
| 5,959,316 | A | 9/1999 | Lowery | |
| 6,147,367 | A | 11/2000 | Yang et al. | 257/88 |
| 6,218,785 | B1 | 4/2001 | Incerti | 315/185 S |
| 6,220,722 | B1 | 4/2001 | Begemann | 362/231 |
| 6,220,731 | B1 | 4/2001 | Ryan | 362/373 |
| 6,227,679 | B1 | 5/2001 | Zhang et al. | |
| 6,234,648 | B1 | 5/2001 | Borner et al. | |
| 6,250,774 | B1 | 6/2001 | Begemann et al. | |
| 6,270,722 | B1 * | 8/2001 | Yang et al. | 422/37 |
| 6,276,822 | B1 | 8/2001 | Bedrosian et al. | |
| 6,350,041 | B1 | 2/2002 | Tarsa et al. | |
| 6,404,131 | B1 | 6/2002 | Kawano et al. | 315/82 |
| 6,465,961 | B1 | 10/2002 | Cao | 315/58 |
| 6,517,221 | B1 | 2/2003 | Xie | 362/373 |
| 6,523,978 | B1 | 2/2003 | Huang | 362/252 |
| 6,550,953 | B1 | 4/2003 | Ichikawa et al. | |
| 6,634,770 | B2 | 10/2003 | Cao | 362/294 |
| 6,659,632 | B2 | 12/2003 | Chen | |
| 6,709,132 | B2 | 3/2004 | Ishibashi | |
| 6,746,885 | B2 | 6/2004 | Cao | 438/26 |
| 6,764,202 | B1 | 7/2004 | Herring et al. | 362/371 |
| 6,803,607 | B1 | 10/2004 | Chan et al. | |
| 6,848,819 | B1 | 2/2005 | Arndt et al. | |
| 6,860,620 | B2 | 3/2005 | Kuan et al. | 362/294 |
| 6,864,513 | B2 | 3/2005 | Lin et al. | |
| 6,910,794 | B2 | 6/2005 | Rice | 362/547 |
| 6,948,829 | B2 | 9/2005 | Verdes et al. | |
| 6,982,518 | B2 | 1/2006 | Chou et al. | |
| 6,997,580 | B2 | 2/2006 | Wong | 362/311.02 |
| 7,048,412 | B2 | 5/2006 | Martin et al. | |
| 7,080,924 | B2 | 7/2006 | Tseng et al. | |
| 7,086,756 | B2 | 8/2006 | Maxik | |
| 7,086,767 | B2 | 8/2006 | Sidwell et al. | |
| 7,094,362 | B2 | 8/2006 | Setlur et al. | 252/301 |
| 7,140,753 | B2 | 11/2006 | Wang et al. | 362/294 |
| 7,144,135 | B2 | 12/2006 | Martin et al. | |
| 7,160,012 | B2 | 1/2007 | Hilscher et al. | |
| 7,160,120 | B2 | 1/2007 | Zhang et al. | |
| 7,165,866 | B2 | 1/2007 | Li | |
| 7,172,314 | B2 | 2/2007 | Currie et al. | |
| 7,213,940 | B1 | 5/2007 | Van De Ven | |
| D546,980 | S | 7/2007 | Lo | |
| 7,270,446 | B2 | 9/2007 | Chang et al. | 362/294 |
| D553,267 | S | 10/2007 | Yuen | |
| 7,350,936 | B2 | 4/2008 | Ducharme et al. | 362/231 |
| 7,354,174 | B1 | 4/2008 | Yan | |
| 7,377,674 | B2 | 5/2008 | Klinkman et al. | 362/484 |
| 7,396,142 | B2 | 7/2008 | Laizure, Jr. et al. | |
| 7,405,857 | B2 | 7/2008 | Ma et al. | |
| 7,413,325 | B2 | 8/2008 | Chen | 362/249.01 |
| D581,556 | S | 11/2008 | To et al. | |
| 7,547,124 | B2 | 6/2009 | Chang et al. | 362/373 |
| 7,549,782 | B2 | 6/2009 | Ng et al. | 362/555 |
| 7,553,047 | B2 | 6/2009 | Shin et al. | 362/294 |
| 7,600,882 | B1 | 10/2009 | Morejon et al. | 362/84 |
| 7,607,802 | B2 | 10/2009 | Kang et al. | 362/294 |
| 7,614,759 | B2 | 11/2009 | Negley | |
| 7,618,157 | B1 | 11/2009 | Galvez | |
| 7,663,315 | B1 | 2/2010 | Hulse | |
| 7,686,478 | B1 | 3/2010 | Hulse | |
| 7,726,836 | B2 | 6/2010 | Chen | |
| 7,740,365 | B2 | 6/2010 | Huttner et al. | 362/97 |
| 7,753,568 | B2 | 7/2010 | Hu et al. | 362/373 |
| 7,810,954 | B2 | 10/2010 | Kolodin | 362/277 |
| 7,824,065 | B2 | 11/2010 | Maxik | |
| D629,928 | S | 12/2010 | Chen | |
| 7,884,538 | B2 | 2/2011 | Mitsuishi et al. | 313/502 |
| 7,976,335 | B2 | 7/2011 | Weber et al. | 439/487 |
| 7,989,236 | B2 | 8/2011 | Yamaguchi et al. | 438/26 |
| 8,021,025 | B2 | 9/2011 | Lee | |
| 8,235,571 | B2 | 8/2012 | Park | 362/555 |
| 8,253,316 | B2 | 8/2012 | Sun et al. | |
| 8,272,762 | B2 | 9/2012 | Maxik et al. | |
| 8,274,241 | B2 | 9/2012 | Guest et al. | 315/294 |
| 8,277,082 | B2 | 10/2012 | Dassanayake et al. | |
| 8,282,250 | B1 | 10/2012 | Dassanayake et al. | |
| 8,292,468 | B2 | 10/2012 | Narendran et al. | |
| 8,309,969 | B2 | 11/2012 | Suehiro et al. | 257/79 |
| 8,314,537 | B2 | 11/2012 | Gielen et al. | 313/46 |
| 8,322,896 | B2 | 12/2012 | Falicoff et al. | |
| 8,348,470 | B2 | 1/2013 | Liu et al. | 362/294 |
| 8,371,722 | B2 | 2/2013 | Carroll | |
| 8,400,051 | B2 | 3/2013 | Hakata et al. | |
| 8,410,512 | B2 | 4/2013 | Andrews | 257/99 |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,449,154 | B2 | 5/2013 | Uemoto et al. | |
| 8,502,468 | B2 | 8/2013 | Li et al. | |
| 8,568,009 | B2 | 10/2013 | Chiang et al. | 362/563 |
| 8,641,237 | B2 | 2/2014 | Chuang | |
| 8,653,723 | B2 | 2/2014 | Cao et al. | |
| 8,696,168 | B2 | 4/2014 | Li et al. | |
| 8,740,415 | B2 | 6/2014 | Wheelock | |
| 8,750,671 | B1 | 6/2014 | Kelly et al. | |
| 8,752,984 | B2 | 6/2014 | Lenk et al. | |
| 8,760,042 | B2 | 6/2014 | Sakai et al. | |
| 8,922,106 | B2 | 12/2014 | Helbing et al. | 313/318.11 |
| 2002/0047516 | A1 | 4/2002 | Iwasa et al. | 313/512 |
| 2003/0021113 | A1 | 1/2003 | Begemann | |
| 2003/0038291 | A1 | 2/2003 | Cao | |
| 2003/0185005 | A1 | 10/2003 | Sommers et al. | |
| 2004/0021629 | A1 | 2/2004 | Sasuga et al. | |
| 2004/0159846 | A1 | 8/2004 | Doxsee | |
| 2004/0201990 | A1 | 10/2004 | Meyer | |
| 2004/0223315 | A1 | 11/2004 | Suehiro et al. | 362/84 |
| 2005/0068776 | A1 | 3/2005 | Ge | 362/296 |
| 2005/0168990 | A1 | 8/2005 | Nagata et al. | 362/294 |
| 2005/0174780 | A1 | 8/2005 | Park | 362/294 |
| 2005/0184638 | A1 | 8/2005 | Mueller et al. | 313/485 |
| 2005/0219060 | A1 | 10/2005 | Curran et al. | 340/815.45 |
| 2005/0225988 | A1 | 10/2005 | Chaves et al. | |

(56) References Cited

U.S. PATENT DOCUMENTS

2005/0242711 A1 11/2005 Bloomfield
2005/0276053 A1 12/2005 Nortrup et al. ..... 362/294
2006/0097245 A1 5/2006 Aanegola et al. ..... 257/26
2006/0097385 A1 5/2006 Negley ..... 257/722
2006/0105482 A1 5/2006 Alferink et al. ..... 438/22
2006/0138435 A1 6/2006 Tarsa et al. ..... 257/89
2006/0152140 A1 7/2006 Brandes ..... 313/503
2006/0152820 A1 7/2006 Lien et al. ..... 359/726
2006/0180774 A1 8/2006 Endo ..... 250/485.1
2006/0227558 A1 10/2006 Osawa et al. ..... 362/351
2007/0047232 A1 3/2007 Kim et al.
2007/0090737 A1 4/2007 Hu et al. ..... 313/11
2007/0091633 A1 4/2007 Harrity et al.
2007/0139938 A1 6/2007 Petroski
2007/0139949 A1 6/2007 Tanda et al. ..... 362/551
2007/0158668 A1 7/2007 Tarsa et al. ..... 257/98
2007/0206375 A1 9/2007 Lys
2007/0215890 A1 9/2007 Harbers et al.
2007/0223219 A1 9/2007 Medendorp
2007/0263405 A1 11/2007 Ng et al. ..... 362/555
2007/0267976 A1 11/2007 Bohler et al. ..... 315/112
2007/0274080 A1 11/2007 Negley et al. ..... 362/341
2007/0285924 A1 12/2007 Morris et al. ..... 362/264
2007/0297183 A1 12/2007 Coushaine
2008/0037257 A1 2/2008 Bolta
2008/0055908 A1 3/2008 Wu et al. ..... 362/294
2008/0062694 A1 3/2008 Lai et al. ..... 362/294
2008/0080165 A1 4/2008 Kim
2008/0093615 A1 4/2008 Lin et al.
2008/0106893 A1 5/2008 Johnson et al.
2008/0117620 A1 5/2008 Hama et al. ..... 362/84
2008/0128735 A1 6/2008 Yoo
2008/0149166 A1 6/2008 Beeson et al. ..... 136/248
2008/0173884 A1 7/2008 Chitnis et al. ..... 257/98
2008/0179611 A1 7/2008 Chitnis et al. ..... 257/98
2008/0232119 A1 9/2008 Ribarich ..... 362/373
2008/0285279 A1 11/2008 Ng et al. ..... 362/249
2008/0308825 A1 12/2008 Chakraborty et al. ..... 257/98
2009/0001399 A1 1/2009 Diana et al. ..... 257/98
2009/0015137 A1 1/2009 Su et al. ..... 313/503
2009/0040760 A1 2/2009 Chen et al. ..... 362/249
2009/0046473 A1 2/2009 Tsai et al. ..... 362/373
2009/0058256 A1 3/2009 Mitsuishi et al. ..... 313/487
2009/0059559 A1 3/2009 Pabst
2009/0067180 A1 3/2009 Tahmosybayat ..... 362/339
2009/0086492 A1 4/2009 Meyer
2009/0095960 A1 4/2009 Murayama ..... 257/79
2009/0101930 A1 4/2009 Li
2009/0103293 A1 4/2009 Harbers et al. ..... 362/231
2009/0103296 A1 4/2009 Harbers
2009/0113296 A1 4/2009 Harbers et al.
2009/0116217 A1 5/2009 Teng et al.
2009/0175041 A1 7/2009 Yuen et al.
2009/0184618 A1 7/2009 Hakata et al.
2009/0190353 A1 7/2009 Barker ..... 362/249
2009/0195186 A1 8/2009 Guest et al. ..... 315/294
2009/0201679 A1 8/2009 Konaka ..... 362/235
2009/0217970 A1 9/2009 Zimmerman et al. ..... 136/252
2009/0262516 A1 10/2009 Li ..... 362/84
2009/0273727 A1 11/2009 Kubota et al. ..... 349/62
2009/0273924 A1* 11/2009 Chiang ..... 362/241
2009/0283779 A1 11/2009 Negley et al. ..... 257/88
2009/0296387 A1 12/2009 Reisenauer et al. ..... 362/235
2009/0310368 A1 12/2009 Incerti et al. ..... 362/326
2009/0316073 A1 12/2009 Chen et al. ..... 349/64
2009/0316383 A1 12/2009 Son
2009/0322197 A1 12/2009 Helbing
2009/0322208 A1 12/2009 Shaikevitch et al. ..... 313/503
2009/0322800 A1 12/2009 Atkins ..... 345/690
2009/0323333 A1 12/2009 Chang
2010/0014839 A1 1/2010 Benoy et al. ..... 386/117
2010/0020547 A1 1/2010 Olsson ..... 362/311
2010/0025700 A1 2/2010 Jung et al. ..... 257/89
2010/0026185 A1 2/2010 Betsuda et al. ..... 315/32
2010/0027258 A1* 2/2010 Maxik et al. ..... 362/240
2010/0038660 A1 2/2010 Shuja ..... 257/98
2010/0046231 A1 2/2010 Medinis ..... 362/294
2010/0060144 A1 3/2010 Justel et al. ..... 313/503
2010/0091487 A1 4/2010 Shin ..... 362/235
2010/0096967 A1 4/2010 Marinus et al. ..... 313/46
2010/0102707 A1 4/2010 Fukuda et al. ..... 313/503
2010/0134047 A1 6/2010 Hasnain
2010/0140655 A1 6/2010 Shi ..... 257/99
2010/0149783 A1 6/2010 Takenaka et al. ..... 362/84
2010/0149814 A1 6/2010 Zhai et al. ..... 257/88
2010/0170075 A1 7/2010 Kanade et al. ..... 29/428
2010/0177522 A1 7/2010 Lee ..... 362/373
2010/0201284 A1 8/2010 Kraus
2010/0207502 A1* 8/2010 Cao et al. ..... 313/46
2010/0219735 A1 9/2010 Sakai et al. ..... 313/46
2010/0232134 A1 9/2010 Tran ..... 362/84
2010/0244729 A1 9/2010 Chen et al. ..... 315/291
2010/0246165 A1 9/2010 Diaz et al. ..... 362/183
2010/0264799 A1 10/2010 Liu et al. ..... 313/46
2010/0314985 A1 12/2010 Premysler ..... 313/46
2010/0327745 A1 12/2010 Dassanayake et al.
2010/0328925 A1 12/2010 Hoelen et al. ..... 362/84
2011/0037368 A1 2/2011 Huang ..... 313/46
2011/0044022 A1 2/2011 Ko et al. ..... 362/84
2011/0058379 A1 3/2011 Diamantidis ..... 362/296.01
2011/0074271 A1 3/2011 Takeshi et al. ..... 313/46
2011/0074296 A1 3/2011 Shen et al. ..... 315/112
2011/0080096 A1 4/2011 Dudik et al. ..... 315/112
2011/0080740 A1 4/2011 Allen et al. ..... 362/294
2011/0089804 A1 4/2011 Mahalingam et al. ..... 313/46
2011/0089830 A1 4/2011 Pickard et al. ..... 315/32
2011/0095686 A1 4/2011 Falicoff et al. ..... 315/35
2011/0133222 A1 6/2011 Allen et al. ..... 257/88
2011/0175528 A1 7/2011 Rains et al. ..... 315/51
2011/0176316 A1 7/2011 Phipps et al.
2011/0205733 A1 8/2011 Lenderink et al. ..... 362/231
2011/0215696 A1 9/2011 Tong et al. ..... 313/46
2011/0215699 A1 9/2011 Le et al.
2011/0216523 A1 9/2011 Tong et al. ..... 362/84
2011/0242816 A1* 10/2011 Chowdhury et al. ..... 362/294
2011/0267835 A1 11/2011 Boonekamp et al. ..... 362/555
2011/0273072 A1 11/2011 Oki ..... 313/46
2011/0291560 A1 12/2011 Wang et al. ..... 315/32
2011/0298371 A1 12/2011 Brandes et al. ..... 315/32
2012/0040585 A1 2/2012 Huang
2012/0155059 A1 6/2012 Hoelen et al. ..... 362/84
2012/0161626 A1 6/2012 Van de Ven et al. ..... 315/35
2012/0320591 A1 12/2012 Liao et al. ..... 362/249
2013/0049018 A1 2/2013 Ramer et al. ..... 257/81
2013/0063945 A1 3/2013 Wu et al. ..... 362/249
2013/0119280 A1 5/2013 Fuchi et al. ..... 250/504 R
2013/0249374 A1 9/2013 Le et al. ..... 313/12
2013/0293098 A1 11/2013 Li et al. ..... 313/512

FOREIGN PATENT DOCUMENTS

CN 1608326 4/2005
CN 1726410 1/2006
CN 1802533 7/2006
CN 101128695 2/2008
CN 101262032 9/2008
CN 1013388887 A 1/2009
CN 101641623 3/2010
CN 102077011 5/2011
DE 4311937 A1 10/1994
DE 10251955 A1 5/2004
DE 102004051382 4/2006
DE 102006061164 6/2008
DE 10 2007 037862 A1 10/2008
DE 202008013667 12/2008
DE 102011004718 8/2012
EP 0876085 11/1998
EP 0876085 A2 11/1998
EP 0890059 A1 1/1999
EP 0936682 A1 8/1999
EP 1058221 A2 12/2000
EP 1881259 1/2008
EP 2146135 A2 1/2010
EP 2154420 2/2010

(56) References Cited

FOREIGN PATENT DOCUMENTS

| | | | |
|---|---|---|---|
| EP | 2469154 | | 6/2012 |
| FR | 2941346 | | 7/2010 |
| GB | 1423011 | | 1/1976 |
| GB | 2345954 | A | 7/2000 |
| GB | 2 366 610 | A | 3/2002 |
| GB | 2366610 | | 3/2002 |
| GB | 2366610 | A | 3/2002 |
| JP | H03081903 | | 4/1991 |
| JP | H06283006 | | 10/1994 |
| JP | H09265807 | | 10/1997 |
| JP | H1 1177149 | | 7/1999 |
| JP | 11-213730 | A | 8/1999 |
| JP | H11260125 | | 9/1999 |
| JP | 2000022222 | | 1/2000 |
| JP | 2000173304 | | 6/2000 |
| JP | 2001118403 | | 4/2001 |
| JP | 2002525814 | | 8/2002 |
| JP | 2003515899 | | 5/2003 |
| JP | 2004146225 | | 5/2004 |
| JP | 2004241318 | | 8/2004 |
| JP | 2005-093097 | A | 4/2005 |
| JP | 2005108700 | | 4/2005 |
| JP | 20051008700 | | 4/2005 |
| JP | 2005244226 | | 9/2005 |
| JP | 2005-286267 | A | 10/2005 |
| JP | 2005277127 | | 10/2005 |
| JP | 2005021635 | | 11/2005 |
| JP | 2006019676 | | 1/2006 |
| JP | 2006108661 | | 4/2006 |
| JP | 2006148147 | | 6/2006 |
| JP | 2006156187 | | 6/2006 |
| JP | 20066159187 | | 6/2006 |
| JP | WO 2006065558 | | 6/2006 |
| JP | 200640850 | A | 9/2006 |
| JP | 2006525648 | | 11/2006 |
| JP | 2006331683 | | 12/2006 |
| JP | 2007049019 | | 2/2007 |
| JP | 200759930 | | 3/2007 |
| JP | 2007059911 | | 3/2007 |
| JP | 2007081090 | | 3/2007 |
| JP | 2007184330 | | 7/2007 |
| JP | 3138653 | | 12/2007 |
| JP | 2008505448 | | 2/2008 |
| JP | 2008508742 | | 3/2008 |
| JP | 2008091140 | | 4/2008 |
| JP | 2008108835 | | 5/2008 |
| JP | 2008523639 | | 7/2008 |
| JP | 2008187195 | | 8/2008 |
| JP | 2008262765 | | 10/2008 |
| JP | 200828183 | | 11/2008 |
| JP | 2008288409 | | 11/2008 |
| JP | 2008300117 | | 12/2008 |
| JP | 2008300203 | | 12/2008 |
| JP | 2008300460 | | 12/2008 |
| JP | 2008300570 | | 12/2008 |
| JP | 2009-016058 | A | 1/2009 |
| JP | 2009016058 | | 1/2009 |
| JP | 2009016153 | | 1/2009 |
| JP | 2009021264 | | 1/2009 |
| JP | 2009059896 | | 3/2009 |
| JP | 2009117346 | | 5/2009 |
| JP | WO 2009093163 | | 7/2009 |
| JP | U 3153766 | | 8/2009 |
| JP | 2009266780 | | 11/2009 |
| JP | 2009277586 | | 11/2009 |
| JP | 2009295299 | | 12/2009 |
| JP | WO 2009148543 | | 12/2009 |
| JP | 2010016223 | | 1/2010 |
| JP | 2010040494 | | 2/2010 |
| JP | 2010050473 | | 3/2010 |
| JP | 2010129300 | | 6/2010 |
| JP | 2010267826 | | 11/2010 |
| KR | 100944181 | | 2/2010 |
| KR | 1020100037353 | | 4/2010 |
| KR | 100980588 | B1 | 9/2010 |
| KR | 3020110008445 | | 3/2011 |
| TW | 200505054 | | 2/2005 |
| TW | 2005807686 | | 2/2005 |
| TW | 200527664 | | 8/2005 |
| TW | 200618339 | | 6/2006 |
| TW | 200619744 | | 6/2006 |
| TW | M 309750 | | 4/2007 |
| TW | 200739151 | | 10/2007 |
| TW | 200806922 | | 2/2008 |
| TW | 200907239 | | 2/2009 |
| TW | 200928435 | | 7/2009 |
| TW | 200938768 | | 9/2009 |
| TW | 200943592 | | 10/2009 |
| TW | D134005 | | 3/2010 |
| TW | 100300960 | | 3/2011 |
| TW | D141681 | | 7/2011 |
| WO | WO 00/17569 | A1 | 3/2000 |
| WO | WO 0124583 | A1 | 5/2001 |
| WO | WO 01/40702 | A1 | 6/2001 |
| WO | WO 0160119 | A2 | 8/2001 |
| WO | WO 2004068599 | | 8/2004 |
| WO | WO 2004100213 | | 11/2004 |
| WO | WO 2005107420 | A2 | 11/2005 |
| WO | WO 2006012043 | | 2/2006 |
| WO | WO 2006059535 | A2 | 6/2006 |
| WO | WO 2006065558 | | 6/2006 |
| WO | WO 2007/130358 | A2 | 11/2007 |
| WO | WO 2007146566 | A2 | 12/2007 |
| WO | WO 2008/018002 | A2 | 2/2008 |
| WO | WO 2008018002 | | 2/2008 |
| WO | WO 2008/052318 | A1 | 5/2008 |
| WO | WO 2008134056 | A1 | 6/2008 |
| WO | WO 2008/117211 | A1 | 10/2008 |
| WO | WO 04100213 | A2 | 11/2008 |
| WO | WO 2008/146229 | A2 | 12/2008 |
| WO | WO 2008146229 | | 12/2008 |
| WO | WO 2009/024952 | A2 | 2/2009 |
| WO | WO 2009052099 | | 4/2009 |
| WO | 2009093163 | | 7/2009 |
| WO | WO 2009/091562 | A2 | 7/2009 |
| WO | WO 2009/093163 | A2 | 7/2009 |
| WO | WO 2009091562 | | 7/2009 |
| WO | WO 2009093163 | | 7/2009 |
| WO | WO 2009093163 | A2 | 7/2009 |
| WO | WO 2009/107052 | A1 | 9/2009 |
| WO | WO 2009107052 | | 9/2009 |
| WO | WO 2009/119038 | A2 | 10/2009 |
| WO | WO 2009/128004 | A1 | 10/2009 |
| WO | WO 2009119038 | | 10/2009 |
| WO | WO 2009125314 | A2 | 10/2009 |
| WO | WO 2009131627 | | 10/2009 |
| WO | WO 2009143047 | A2 | 11/2009 |
| WO | WO 2009/158422 | A1 | 12/2009 |
| WO | WO 2009158422 | | 12/2009 |
| WO | WO 2009158422 | A1 | 12/2009 |
| WO | WO 2010/012999 | A2 | 2/2010 |
| WO | WO 2010012999 | | 2/2010 |
| WO | WO 2010013893 | | 2/2010 |
| WO | WO 2010052640 | | 5/2010 |
| WO | WO 2010/119618 | A1 | 10/2010 |
| WO | WO 2010/128419 | A1 | 11/2010 |
| WO | WO 2011100193 | | 8/2011 |
| WO | WO 2011109091 | A1 | 9/2011 |
| WO | WO 2011109098 | | 9/2011 |
| WO | WO 2012011279 | | 1/2012 |
| WO | WO 2012031533 | | 3/2012 |

OTHER PUBLICATIONS

Response to OA from U.S. Appl. No. 13/028,946, filed Oct. 8, 2012.
Office Action from U.S. Appl. No. 13/029,025, dated Jul. 16, 2013.
Office Action from U.S. Appl. No. 13/430.478, dated Jun. 18, 2013.
Office Action from U.S. Appl. No. 12/901,405, dated Jul. 1, 2013.
Office Action from U.S. Appl. No. 13/018,291, dated Oct. 10, 2012.
Response to OA from U.S. Appl. No. 13/018,291, filed Jan. 7, 2013.
Office Action from U.S. Appl. No. 13/022,490, dated Nov. 7, 2012.
Response to OA from U.S. Appl. No. 13/022,490, filed Feb. 1, 2013.
Office Action from U.S. Appl. No. 13/034,501, dated Dec. 3, 2012.
Response to OA from U.S. Appl. No. 13/034,501, filed Apr. 3, 2013.

(56) References Cited

OTHER PUBLICATIONS

Office Action from U.S. Appl. No. 13/028,946, dated Dec. 4, 2012.
Response to OA from U.S. Appl. No. 13/028,946, filed Jan. 29, 2013.
Office Action from U.S. Appl. No. 13/029,005, dated Jan. 24, 2013.
Office Action from U.S. Appl. No. 12/901,405, dated Jan. 9, 2013.
Response to OA from U.S. Appl. No. 12/901,405, filed Apr. 29, 2013.
Office Action from U.S. Appl. No. 12/985,275, dated Feb. 28, 2013.
Response to OA from U.S. Appl. No. 12/985,275, filed May 28, 2013.
Office Action from U.S. Appl. No. 13/018,291, dated Mar. 20, 2013.
Response to OA from U.S. Appl. No. 13/018,291, filed May 20, 2013.
Office Action from U.S. Appl. No. 13/022,490, dated Apr. 2, 2013.
Office Action from U.S. Appl. No. 13/018,291, dated May 31, 2013.
Office Action from U.S. Appl. No. 12/636,958, dated Jul. 19, 2012.
Response to OA from U.S. Appl. No. 12/636,958, filed Nov. 19, 2012.
Office Action from U.S. Appl. No. 13/054,501, dated May 31, 2013.
Office Action from U.S. Appl. No. 13/028,946, filed Apr. 11, 2013.
Office Action from U.S. Appl. No. 13/028,913, dated Apr. 29, 2013.
Office Action from U.S. Appl. No. 13/029,005, dated Jan. 4, 2013.
Response to OA from U.S. Appl. No. 13/029,005, filed Apr. 17, 2013.
Office Action from U.S. Appl. No. 12/848,825, dated Nov. 5, 2012.
Response to OA from U.S. Appl. No. 12/848,825, filed Feb. 5, 2013.
Office Action from U.S. Appl. No. 13/029,005, dated Jun. 11, 2013.
First Office Action and Search Report from Chinese Patent Appl. No. 201180022620X. dated Jul. 1, 2014.
Office Action from U.S. Appl. No. 13/358,901, dated Jul. 15, 2014.
Response to OA from U.S. Appl. No. 13/358,901, filed Aug. 21, 2014.
Office Action from U.S. Appl. No. 13/340,478, dated Jul. 23, 2014.
Office Action from U.S. Appl. No. 14/014,272, dated Jul. 29, 2014.
Office Action from U.S. Appl. No. 13/029,025, dated Aug. 6, 2014.
Office Action from U.S. Appl. No. 12/985,275, dated Aug. 7, 2014.
Office Action from U.S. Appl. No. 12/901,405, dated Aug. 7, 2014.
First Office Action from Chinese Patent Appl. No. 2011800223856, dated Aug. 1, 2014.
First Office Action from Chinese Patent Appl. No. 2011800226248, dated Aug, 25, 2014.
Official Action from European Patent Appl. No. 11710348.1-1757, dated Oct. 9. 2014.
Office Action from Japanese Patent Appl. No. 2012-556065, dated Aug. 5, 2014.
Office Action from Japanese Patent Appl. No. 2012-556062, dated Aug. 5, 2014.
First Office Action from Chinese Patent Appl. No. 2011800223837, dated Jul. 24, 2014.
Office Action from European Patent Appl. No. 11710906.6-1757, dated Sep. 10, 2014.
Notice of Reasons for Rejection from Japanese Patent Appl No. 2012-543086, dated Dec. 24, 2013.
Office Action from Japanese Patent Appl. No. 2012-556062, dated Dec. 20, 2013.
International Preliminary Report on Patentability and Written Opinion from PCT/US2012/044705 dated Jan. 7, 2014.
Notice of Reasons for Rejection from Japanese Patent Appl. No. 2012-543086, dated Aug. 27, 2013.
Notice to Submit a Response from Korean Design Patent Application No. 30-2011-0024961, dated Sep. 10. 2012.
International Search Report and Written Opinion from PCT Application No. PCT/US2012/044705 dated Oct. 9, 2012.
Notice to Submit a Response from Korean Patent Application No. 30-2011-0008446, dated Oct. 22. 2012.
First Office Action from Chinese Patent Appl. No. 201080062056.X, dated Feb. 12, 2014.
Office Action from U.S. Appl. No. 13/028,913, dated Feb. 19, 2014.
Office Action from U.S. Appl. No. 13/028,863, dated Mar. 4, 2014.
Office Action from U.S. Appl. No. 13/430,478, dated Feb. 21, 2014.
Office Action from U.S. Appl. No. 13/358,901, dated Mar. 6, 2014.
Office Action from U.S. Appl. No. 13/018,291, dated Mar. 7, 2014.
Office Action from U.S. Appl. No. 13/029.025, dated Mar. 19, 2014.
International Search Report and Written Opinion from PCT Application No. PCT/US2011/000389, dated May 6. 2013.
International Search Report and Written Opinion from PCT Application No. PCT/US2011/000390, dated May 6. 2013.
International Preliminary Report on Patentability from PCT/US2011/00389, dated May 8. 2013.
International Preliminary Report on Patentability from PCT/US2011/000390, dated May 8. 2013.
Reasons for Rejection from Japanese Patent Appl. No. 2011-198454, dated Mar. 7, 2013.
Office Action from U.S. Appl. No. 13/029,063, dated Apr. 1, 2014.
Office Action from U.S. Appl. No. 12/985,275, dated Apr. 10, 2014.
Office Action from U.S. Appl. No. 13/029,068, dated Apr. 24, 2014.
Office Action from U.S. Appl. No. 13/034,501, dated May 5, 2014.
Office Action from U.S. Appl. No. 13/022,490, dated May 6, 2014.
Office Action from U.S. Appl. No. 13/028,863, dated May 9, 2014.
Office Action from U.S. Appl. No. 13/029,068, dated Jun. 13, 2014.
Office Action from U.S. Appl. No. 13/018,245, dated Jun. 10, 2014.
Decision to Grant from Japanese Patent Appl. No. 2012-556066, dated Jul. 4, 2014.
Decision of Rejection from Japanese Patent Appl. No. 2012-556064. dated Jun. 6. 2014.
Notice to Submit a Response from Korean Patent Application No. 30-2011-0008448, dated Apr. 16, 2012.
Notice to Submit a Response from Korean Patent Application No. 30-2011-0008445, dated Apr. 16. 2012.
Notice to Submit a Response from Korean Patent Application No. 30-2011-0008446, dated Apr. 16, 2012.
Office Action for Taiwanese Patent Application No. 100300961, dated May 7. 2012.
Office Action from Taiwanese Patent Application No. 100300960, dated May 7, 2012.
U.S Appl. No. 12/757,179, filed Apr. 9, 2010. Yuan, et al.
U.S. Appl. No. 12/901,405, filed Oct. 8, 2010, Tong.
U.S. Appl. No. 61/339,515, filed Mar. 3, 2010. Tong.
U.S. Appl. No. 12/975,820, Van De Ven.
U.S. Appl. No. 13/029.063, filed Feb. 16, 2011, Hussell.
U.S. Appl. No. 13/358,901, filed Jan. 26, 2012, Progl. et al.
U.S. Appl. No. 61/435.759, filed Jan. 24, 2011, Le.
U.S. Appl. No. 61/339,516, filed Mar. 3, 2010 Tong.
US Publication No. 2010/0155763, Filing Date Jun. 24, 2010 Donofrio.
U.S. Appl. No. 61/424,670, filed Dec. 19, 2010, Zongjie Yuan.
Cree. Xlamp® LEDS, Product Info and Data Sheets, 34 PAGES.
Nichia Corp Part Spec, *High Brightness LEDS*, (May 1999). 15 PGS EA. (NSPW 300BS. NSPW 312BS, Etc).
U.S. Appl. No. 13/022,490, Feb. 7, 2011, Tong.
U.S. Appl. No. 13/358,901, Jan. 26, 2012. Progl. et al.
Energy Star® Program Requirements for Integral LED Lamps, amended Mar. 22, 2010.
U.S. Appl. No. 12/757,179, filed Apr. 9, 2010, Yuan, et al.
U.S. Appl. No. 13/358,901, filed Jan. 26,2012, Progl, et al.
International Search Report and Written Opinion for PCT Application No. PCT/US2011/000391 mailed Oct. 6, 2011.
International Search Report and Written Opinion for PCT Application No. PCT/US2011/000402 mailed Sep. 30, 2011.
International Search Report and Written Opinion for PCT Application No. PCT/US2011/000399 mailed Jul. 12, 2011.
Decision to Refuse a European Patent Application for EP 09 152 962.8 dated Jul. 6, 2011.
International Search Report and Written Opinion for PCT/US2011/000407 mailed Nov. 16, 2011.
International Search Report and Written Opinion for PCT Patent Application No. PCT/US2011/000405 mailed Nov. 2, 2011.
Office Action of the IPO for Taiwan Patent Application No. TW 100300962 issued Nov. 21, 2011.
Office Action of the IPO for Taiwan Patent Application No. TW 100300961 issued Nov. 16, 2011.
Office Action of the IPO for Taiwan Patent Application No. TW 100300960 issued Nov. 15, 2011.
Office Action of the IPO for Taiwan Patent Application No. TW 100302770 issued Jan. 13, 2012.

(56) References Cited

OTHER PUBLICATIONS

Decision for Final Rejection for Japanese Patent Application No. 2001-542133 mailed Jun. 28, 2011.
International Search Report and Written Opinion for PCT/US2011/000403 mailed Aug. 23, 2011.
International Search Report and Written Opinion for PCT/US2011/000404 mailed Aug. 25, 2011.
International Search Report and Written Opinion for PCT/US2011/000398 mailed Aug. 30, 2011.
International Search Report and Written Opinion for PCT/US2011/000406 mailed Sep. 15, 2011.
International Search Report and Written Opinion for counterpart PCT Application No. PCT/US2011/000397 mailed May 24, 2011.
U.S. Appl. No. 13/018,245, filed Jan. 31, 2011, Tong.
U.S. Appl. No. 61/339.515, filed Mar. 3, 2010, Tong.
U.S. Appl. No. 12/848.825, filed Aug. 2, 2010, Tong.
U.S. Appl. No. 13/017.778, filed Jan. 31, 2011, Andrews.
International Search Report and Written Opinion for PCT Application No. PCT/US2010/003146 mailed Jun. 7, 2011.
International Search Report and Written Opinion for PCT/US2011/000400 mailed May 2, 2011.
International Search Report and Written Opinion, PCT/US2009/063804, Mailed on Feb. 26, 2010.
U.S. Appl. No. 12/566,195, Van De Ven, filed Sep. 24, 2009.
U.S. Appl. No. 12/704,730, Van De Ven, filed Feb. 12, 2010.
C.Crane Geobulb® —II LED Light Bulb, Item #2SW, Description, p. 1-2.
Cree LR4, 4" and 6" Recessed Architectural Downlight, Product Info p. 1-2.
Office Action from Japanese Patent appl. No. 2012-556063, dated Jan. 28, 2014.
Comments on the Written Opinion and Amendment of the Application from European Patent appl. No. 12740244.4, dated Feb. 20, 2014.
International Search Report and Written Opinion from PCT/US2013/057712 dated Feb. 4, 2014.
Office Action from U.S. Appl. No. 11/149,999, dated Jan. 15, 2014.
Office Action from U.S. Appl. No. 13/034,501, dated Jan. 23, 2014.
Office Action from Japanese Patent Appl. No. 2012-556066, dated Mar. 14. 2014.
First Office Action from Chinese Patent Application No. 2011800207069, dated May 5, 2014.
First Office Action from Chinese Patent Application No. 201180022606, dated May 4, 2014.
First Office Action from Chinese Patent Appl. No. 201180020709.2, dated May 4, 2014.
Office Action from U.S. Appl. No. 13/028,946, dated May 27, 2014.
Office Action from U.S. Appl. No. 13/028,913, dated May 22, 2014.
Search Report and Written Opinion from PCT Application No. PCT/US2012/072108, dated Feb. 27, 2013.
Office Action from U.S. Appl. No. 13/022,490, dated Oct. 17, 2013.
Office Action from U.S. Appl. No. 11/149,999, dated May 13, 2013.
Response to OA from U.S. Appl. No. 11/149,999, filed Sep. 13, 2013.
Office Action from U.S. Appl. No. 12/985,275, dated Aug. 27, 2013.
Office Action from U.S. Appl. No. 13/358,901, dated Oct. 9, 2013.
Office Action from U.S. Appl. No. 13/028,863, dated Jul. 30, 2013.
Decision of Dismissal of Amendment, Decision of Rejection from Japanese Patent Appl. No. 2011-231319, dated Oct. 15, 2013.
Office Action from Japanese Patent Appl No. 2012-556063, dated Oct 11, 2013.
Office Action from Japanese Patent Appl. No. 2012-556066, dated Oct. 25, 2013.
Office Action from Japanese Patent Appl. No. 2012-556065, dated Oct. 25, 2013.
Office Action from U.S. Appl. No. 13/028.913, dated Nov. 4, 2013.
Office Action from Japanese Patent Appl. No. 2012-556064, dated Oct. 29. 2013.
Office Action from U.S. Appl. No. 13/029,063, dated Oct. 23, 2013.
Office Action from U.S. Appl. No. 13/028,946, dated Oct. 31, 2013.
Office Action from U.S. Appl. No. 13/029,068, dated Nov. 15, 2013.
Office Action from U.S. Appl. No. 13/029,025, dated Dec. 6, 2013.
Second Office Action from Chinese Appl. No. 201080062056.X, dated Sep. 29, 2014.
First Office Action and Search Report from Chinese Appl. No. 2011800223856, dated Aug. 1, 2014.
Communication from European Appl. No. 12816621.2-1757, dated Sep. 25, 2014.
Pretrial Report from Japanese Patent Appl. No. 2011-231319, dated Apr. 14, 2014.
Office Action from U.S. Appl. No. 13/029.068, dated Sep. 26, 2014.
Response to OA from U.S. Appl. No. 13/029,068, filed Nov. 18, 2014.
Office Action from U.S. Appl. No. 13/358,901, dated Oct. 31, 2014.
Office Action from U.S. Appl. No. 13/430,478, dated Nov. 5, 2014.
Office Action from U.S. Appl. No. 13/034,501, dated Nov. 5, 2014.
Office Action from U.S. Appl. No. 13/028,863, dated Nov. 10, 2014.
Decision to Grant from Japanese Appl. No. 2012-556062, dated Nov. 27, 2014.
Second Office Action from Chinese Patent Appl. No. 2011800207069, dated Dec. 5. 2014.
Summons to Oral Proceedings from European Patent Appl. No. 09152962/2166580, dated Jan. 29, 2015.
First Office Action from Chinese Patent Appl. No. 2011800225832, dated Jan. 20. 2015.
First Office Action from Chinese Patent Appl. No. 2011800226214, dated Dec. 25, 2014.
Second Office Action and Search Report from Chinese Patent Appl. No. 2011800207092, dated Jan. 22. 2015.
Examination Report from European Patent Appl. No. 11 710 348.1-1757. dated Feb. 18, 2015.
Examination Report from European Patent Appl. No. 11 710 906.6-1757. dated Feb. 18, 2015.
Examination Report from European Patent Appl. No. 12 740 244.4-1757, dated Feb. 9, 2015.
Office Action from U.S. Appl. No. 13/029,063, dated Jan. 13, 2015.
Office Action from U.S. Appl. No. 14/014,272, dated Jan. 14, 2015.
Response to OA from U.S. Appl. No. 14/014,272, filed Mar. 3, 2015.
Office Action from U.S. Appl. No. 12/901,405, dated Feb. 4, 2015.
First Office Action from Chinese Appl. No. 201180022626.7, dated Nov. 15. 2014.
Second Office Action from Chinese Appl. No. 201180022606X, dated Dec. 23. 2014.
Appeal Decision from Japanese Appl. No. 2011-231319, dated Jan. 13. 2015.
Office Action from U.S. Appl. No. 13/029,025, dated Dec. 11, 2014.
Office Action from U.S. Appl. No. 13/018,245, dated Dec. 11, 2014.
Office Action from U.S. Appl. No. 13/029,068, dated Dec. 23, 2014.
Office Action from U.S. Appl. No. 12/985,275, dated Dec. 29, 2014.
Communication from European Patent Appl. No. 13762957.2-1757, dated Apr. 30, 2015.
Second Office Action from Chinese Patent Appl. No. 2011800223856, dated Apr. 16, 2015.
Office Action from Taiwanese Patent Appl. No. 100107048, dated Apr. 24, 2015.
Notice of Decline of Amendments and Final Office Action from Japanese Appl. No. 2012-556065.
Second Office Action from Chinese Patent Appl. No. 2011800223837, dated Apr. 13, 2015.
Office Action and Search Report from Taiwanese Patent Appl. No. 100107051, dated May 12, 2015.
Third Office Action from Chinese Patent Appl. No. 2011800207069, dated Apr. 13, 2015.
Second Office Action from Chinese Patent Appl. No. 2011800226248, dated May 4, 2015.
Office Action from Taiwanese Appl. No. 100107047, dated Jun. 5, 2015.
Second Office Action from Chinese Appl. No. 201180022620X, dated Apr. 20, 2015.
Office Action from Taiwanese Appl. No. 100107040, dated Jun. 5, 2015.
Office Action from Taiwanese Patent Appl. No. 10420724800, dated Jun. 2, 2015.
Office Action from U.S. Appl. No. 13/029,068, dated Mar. 31, 2015.

(56) References Cited

OTHER PUBLICATIONS

Office Action from U.S. Appl. No. 11/149,999, dated Mar. 31, 2015.
Office Action from U.S. Appl. No. 12/985.275, dated Apr. 3, 2015.
Office Action from U.S. Appl. No. 13/430,478, dated Apr. 22, 2015.
Office Action from U.S. Appl. No. 13/029,025. dated Apr. 29, 2015.
Office Action from U.S. Appl. No. 13/018,245, dated May 28, 2015.
Office Action from U.S. Appl. No. 13/028,863, dated Jun. 3, 2015.
Office Action from U.S. Appl. No. 13/758,763, dated Jun. 5, 2015.
Office Action from U.S. Appl. No. 14/185.123, dated Jun. 9, 2015.
Search Report and Office Action from Taiwanese Patent Appl. No. 099143827, dated Jun. 12, 2015.
Office Action from Taiwanese Patent Appl. No. 100107012, dated Jul. 22, 2015.
Decision of Board of Appeal and Minutes of Oral Proceedings from European Appl. No. 09152962, dated Jun. 2. 2015.
Decision to Grant from Chinese Patent Appl. No. 201080062056.X, dated Jul. 6, 2015.
Office Action from Taiwanese Appl. No. 101107038, dated Jul. 21, 2015.
Office Action from Taiwanese Patent Appl. No. 100107042, dated Jun. 2, 2015.
Office Action from Taiwanese Patent Appl. No. 100107047, dated Jun. 2, 2015.
Office Action from Taiwanese Patent Appl. No. 100107040, dated Jun. 2, 2015.
Office Action from Taiwanese Patent Appl. No. 100107044, dated Jun. 1, 2015.
Third Office Action from Chinese Patent Appl. No. 201180022606X, dated Jun. 10. 2015.
Office Action from Japanese Patent Appl. No, 2014-122643, dated Apr. 10, 2015.
Third Office Action from Chinese Patent Appl. No. 2011800207092. dated Jul. 13, 2015.
Notice of Allowance from Japanese Patent Appl. No. 2014-122643. dated Sep. 3, 2015.
Notification of the Fourth Office Action from Chinese Patent Appl. No. 2011800207069. dated Aug. 24. 2015.
Decision of Rejection from Japanese Patent Appl. No. 2012-566065, dated Aug. 18, 2015.
Second Office Action from Chinese Patent Appl. No. 2011800226267, dated Aug. 3, 2015.
Office Action from U.S. Appl. No. 13/029,025, dated Aug. 17, 2015.
Office Action from U.S. Appl. No. 13/430.478, dated Aug. 27, 2015.
Office Action from U.S. Appl. No. 12/985,275, dated Sep. 2, 2015.
Office Action from U.S. Appl. No. 13/029,068, dated Sep. 8, 2015.
Office Action from U.S. Appl. No. 13/029,063, dated Sep. 17, 2015.
Office Action from U.S. Appl. No. 11/149.999, dated Oct. 1, 2015.

* cited by examiner

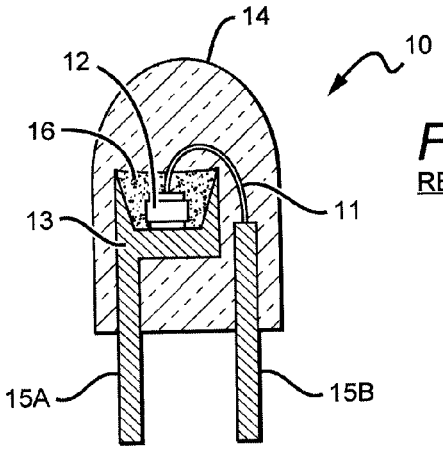
FIG. 1
RELATED ART
FIG. 2
RELATED ART
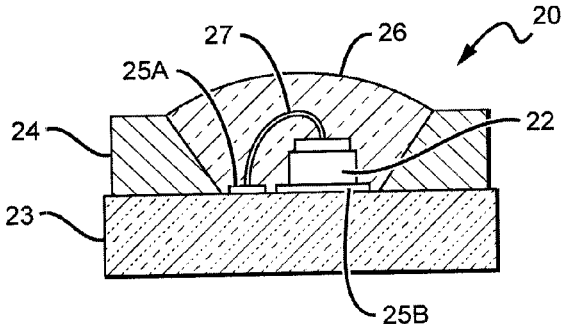
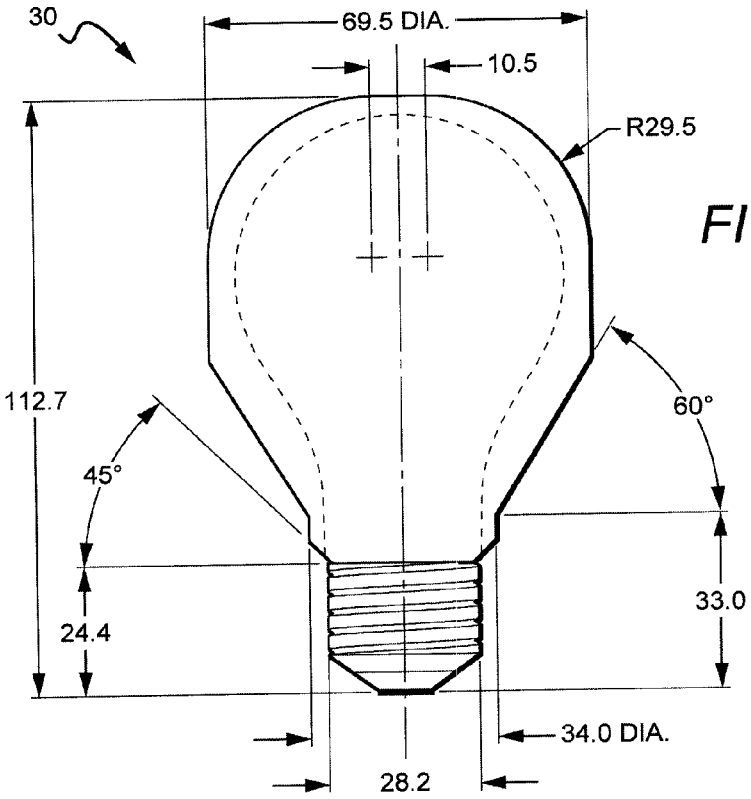
FIG. 3

FIG. 4
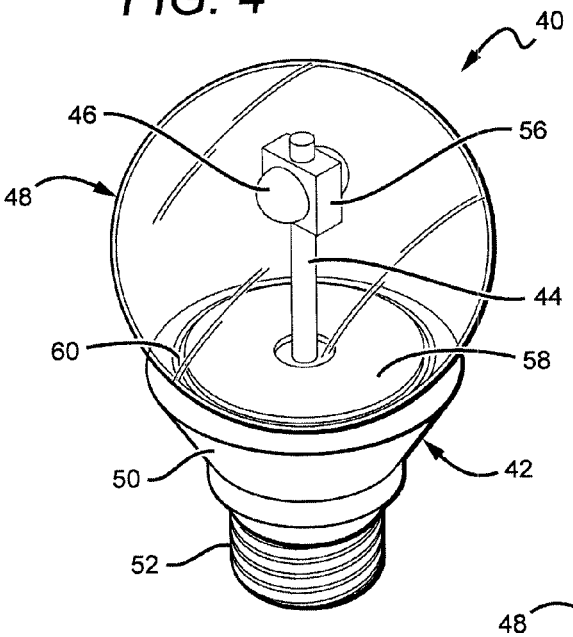
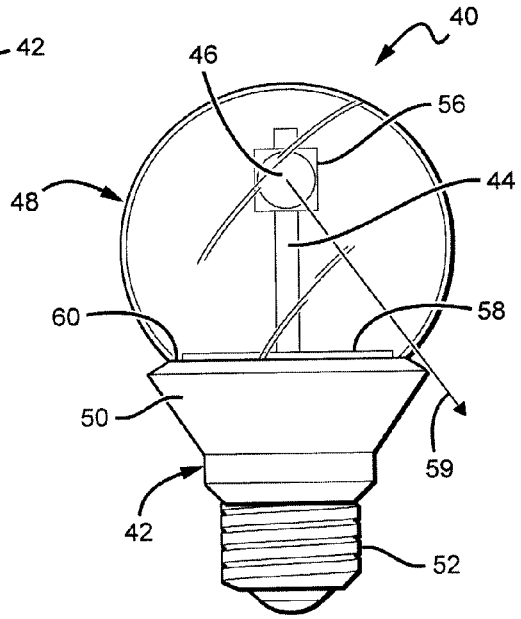
FIG. 5
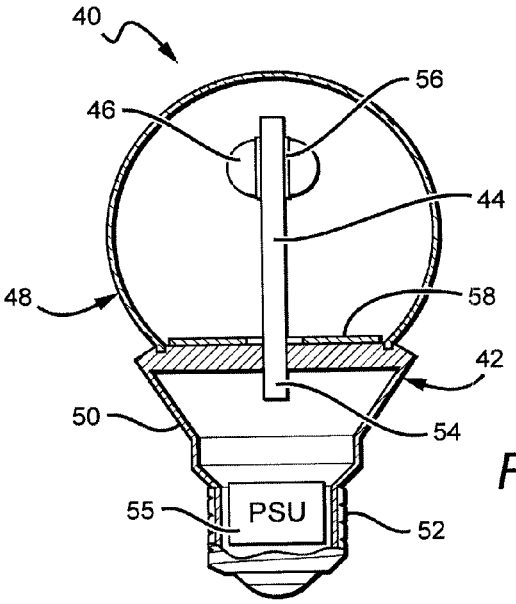
FIG. 6

FIG. 7
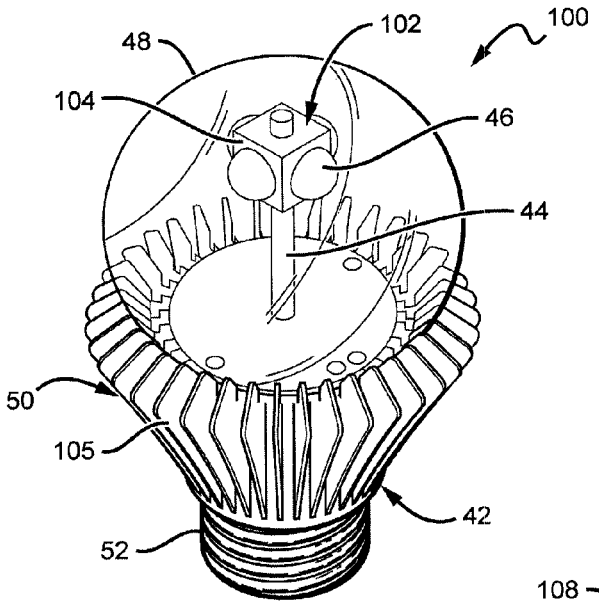
FIG. 8
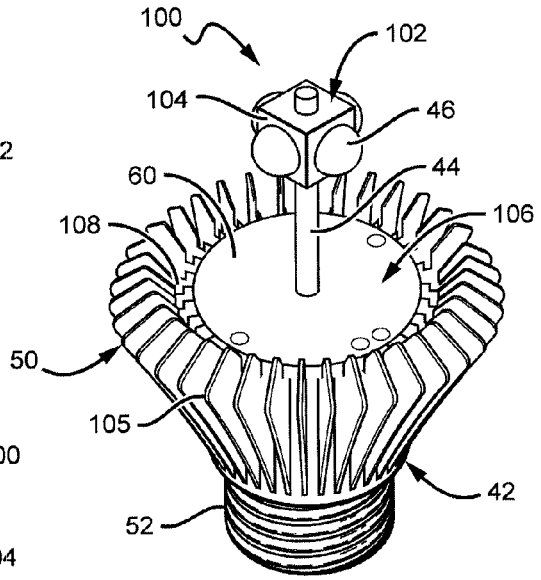
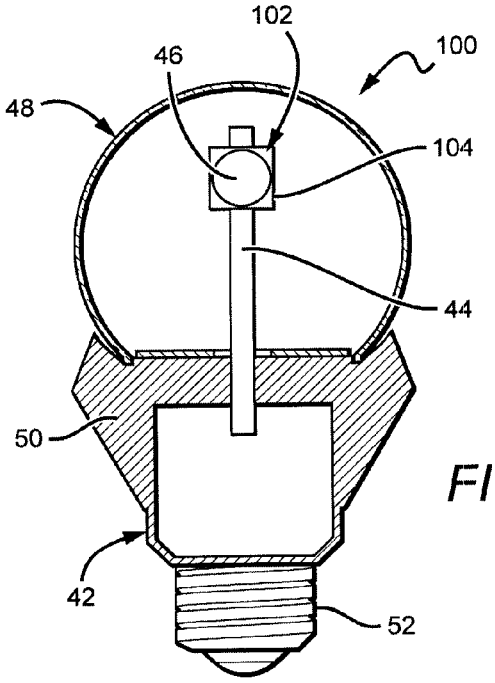
FIG. 10

FIG. 12
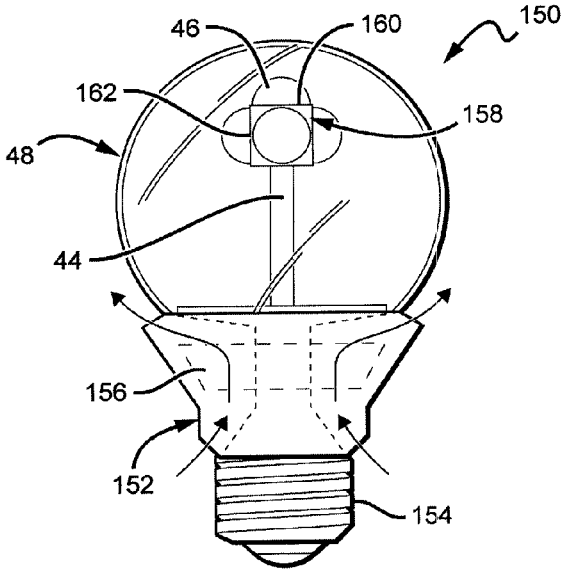
FIG. 13
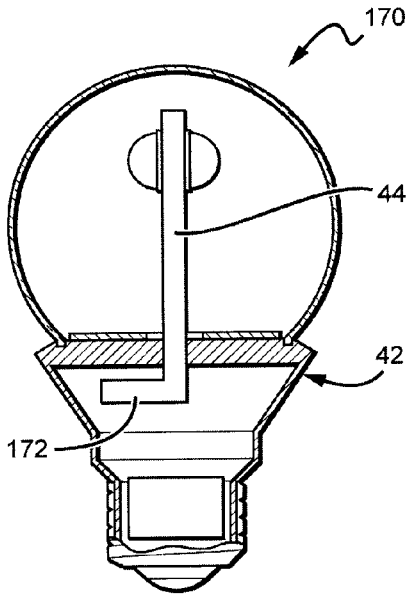
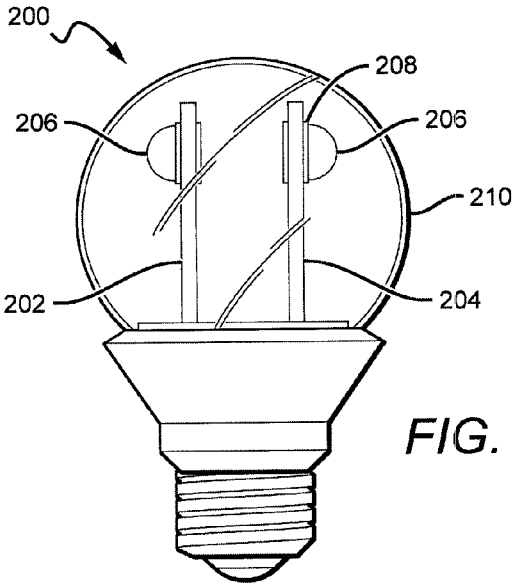
FIG. 14

FIG. 15
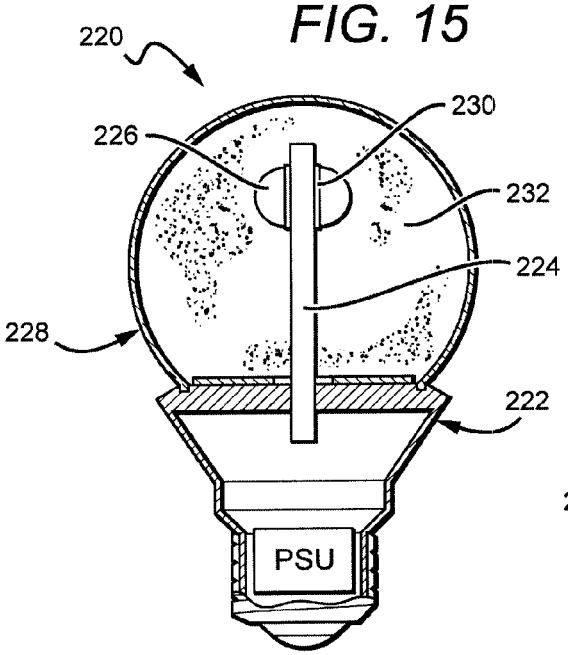
FIG. 16
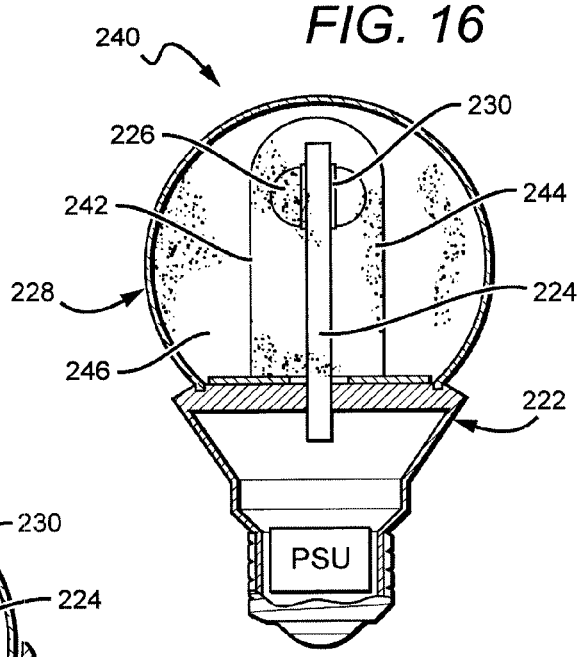
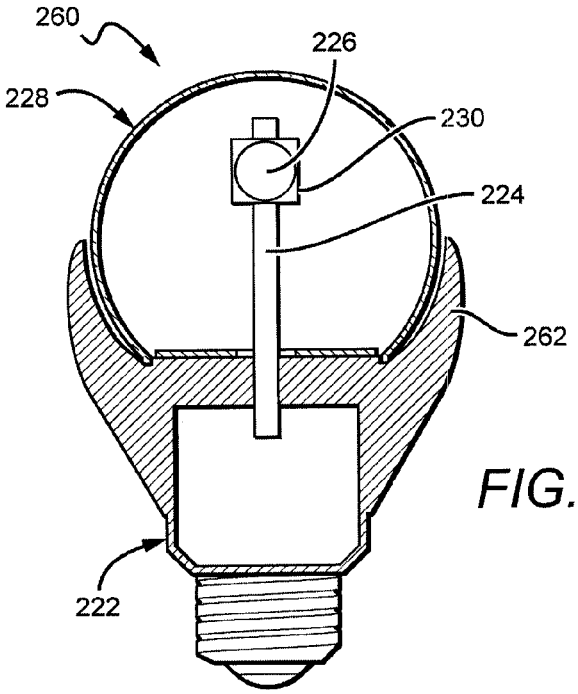
FIG. 17

FIG. 18
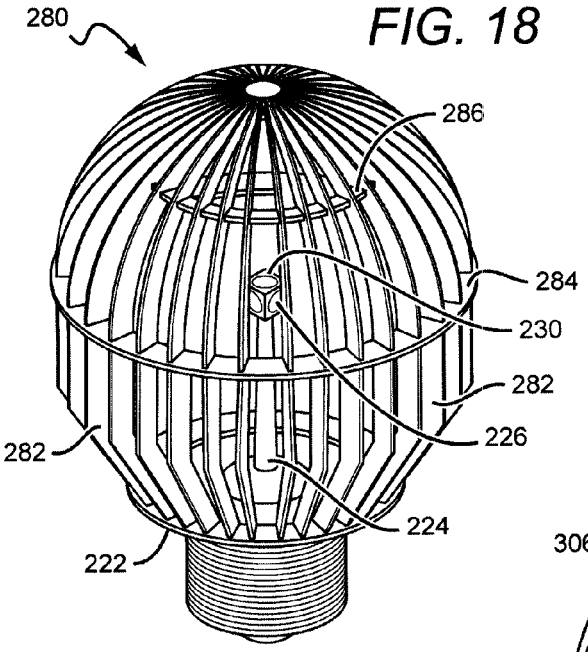
FIG. 19
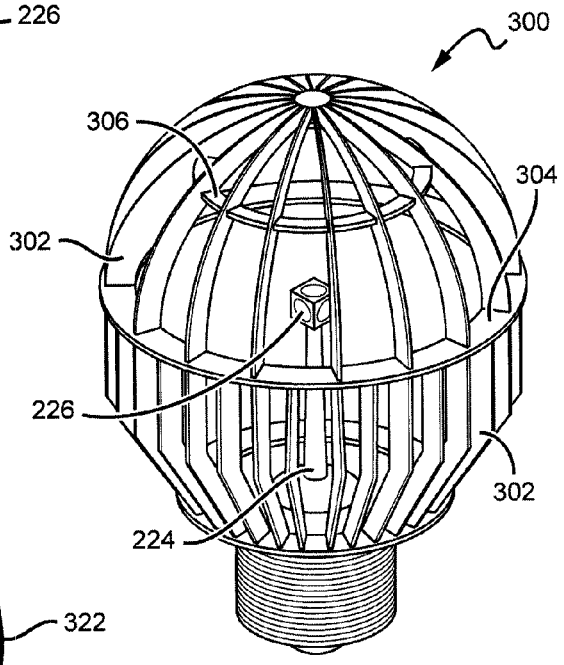
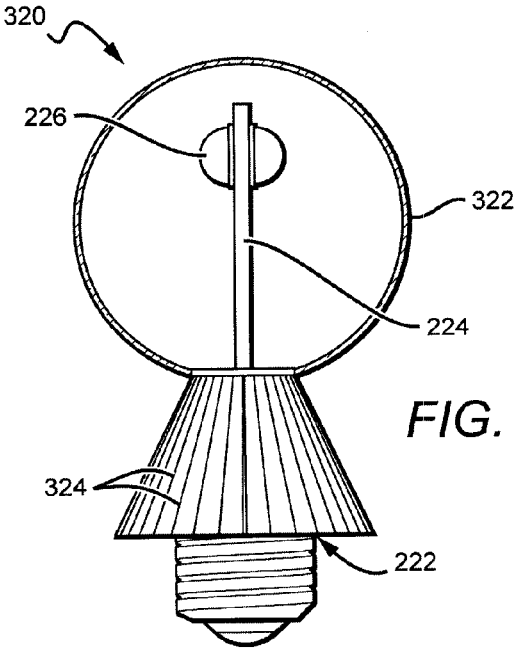
FIG. 20

LAMP WITH REMOTE LED LIGHT SOURCE AND HEAT DISSIPATING ELEMENTS

This application is a continuation in part of and claims the benefit of U.S. patent application Ser. No. 13/022,142, filed on Feb. 7, 2011, and is also a continuation-in-part of and claims the benefit of U.S. patent application Ser. No. 13/358,901, filed on Jan. 16, 2012.

BACKGROUND OF THE INVENTION

1. Field of the Invention

This invention relates to solid state lamps and bulbs and in particular to light emitting diode (LED) based lamps and bulbs capable of providing omnidirectional emission patterns similar to those of filament based light sources.

2. Description of the Related Art

Light emitting diodes (LED or LEDs) are solid state devices that convert electric energy to light, and generally comprise one or more active layers of semiconductor material sandwiched between oppositely doped layers. When a bias is applied across the doped layers, holes and electrons are injected into the active layer where they recombine to generate light. Light is emitted from the active layer and from all surfaces of the LED.

In order to use an LED chip in a circuit or other like arrangement, it is known to enclose an LED chip in a package to provide environmental and/or mechanical protection, color selection, light focusing and the like. An LED package also includes electrical leads, contacts or traces for electrically connecting the LED package to an external circuit. In a typical LED package 10 illustrated in FIG. 1, a single LED chip 12 is mounted on a reflective cup 13 by means of a solder bond or conductive epoxy. One or more wire bonds 11 connect the ohmic contacts of the LED chip 12 to leads 15A and/or 15B, which may be attached to or integral with the reflective cup 13. The reflective cup 13 may be filled with an encapsulant material 16 which may contain a wavelength conversion material such as a phosphor. Light emitted by the LED at a first wavelength may be absorbed by the phosphor, which may responsively emit light at a second wavelength. The entire assembly is then encapsulated in a clear protective resin 14, which may be molded in the shape of a lens to collimate the light emitted from the LED chip 12. While the reflective cup 13 may direct light in an upward direction, optical losses may occur when the light is reflected (i.e. some light may be absorbed by the reflector cup due to the less than 100% reflectivity of practical reflector surfaces). In addition, heat retention may be an issue for a package such as the package 10 shown in FIG. 1, since it may be difficult to extract heat through the leads 15A, 15B.

A conventional LED package 20 illustrated in FIG. 2 may be more suited for high power operations which may generate more heat. In the LED package 20, one or more LED chips 22 are mounted onto a carrier such as a printed circuit board (PCB) carrier, substrate or submount 23. A metal reflector 24 mounted on the submount 23 surrounds the LED chip(s) 22 and reflects light emitted by the LED chips 22 away from the package 20. The reflector 24 also provides mechanical protection to the LED chips 22. One or more wirebond connections 11 are made between ohmic contacts on the LED chips 22 and electrical traces 25A, 25B on the submount 23. The mounted LED chips 22 are then covered with an encapsulant 26, which may provide environmental and mechanical protection to the chips while also acting as a lens. The metal reflector 24 is typically attached to the carrier by means of a solder or epoxy bond.

LED chips, such as those found in the LED package 20 of FIG. 2 can be coated by conversion material comprising one or more phosphors, with the phosphors absorbing at least some of the LED light. The LED chip can emit a different wavelength of light such that it emits a combination of light from the LED and the phosphor. The LED chip(s) can be coated with a phosphor using many different methods, with one suitable method being described in U.S. patent application Ser. Nos. 11/656,759 and 11/899,790, both to Chitnis et al. and both entitled "Wafer Level Phosphor Coating Method and Devices Fabricated Utilizing Method". Alternatively, the LEDs can be coated using other methods such as electrophoretic deposition (EPD), with a suitable EPD method described in U.S. patent application Ser. No. 11/473,089 to Tarsa et al. entitled "Close Loop Electrophoretic Deposition of Semiconductor Devices".

Lamps have been developed utilizing solid state light sources, such as LEDs, with a conversion material that is separated from or remote to the LEDs. Such arrangements are disclosed in U.S. Pat. No. 6,350,041 to Tarsa et al., entitled "High Output Radial Dispersing Lamp Using a Solid State Light Source." The lamps described in this patent can comprise a solid state light source that transmits light through a separator to a disperser having a phosphor. The disperser can disperse the light in a desired pattern and/or changes its color by converting at least some of the light through a phosphor. In some embodiments, the separator spaces the light source a sufficient distance from the disperser such that heat from the light source will not transfer to the disperser when the light source is carrying elevated currents necessary for room illumination.

Different LED based bulbs have been developed that utilize large numbers of low brightness LEDs (e.g. 5 mm LEDs) mounted to a three-dimensional surface to achieve wide-angle illumination. These designs, however, do not provide optimized omnidirectional emission that falls within standard uniformity requirements. These bulbs also contain a large number of interconnected LEDs making them prohibitively complex, expensive and unreliable. This makes these LED bulbs generally impractical for most illumination purposes.

Other LED bulbs have also been developed that use a mesa-type design for the light source with one LED on the top surface and seven more on the sidewalls of the mesa. (see GeoBulb®-II provided by C. Crane). This arrangement, however, does not provide omnidirectional emission patterns, but instead provides a pattern that is substantially forward biased. The mesa for this bulb also comprises a hollow shell, which can limit its ability to thermally dissipate heat from the emitters. This can limit the drive current that can be applied to the LEDs. This design is also relatively complex, using several LEDs, and not compatible with large volume manufacturing of low-cost LED bulbs.

SUMMARY OF THE INVENTION

The present invention provides various embodiments of solid state lamps and bulbs that are efficient, reliable and cost effective and can be arranged to provide omnidirectional emission patterns. The different embodiments comprise elements to elevate the solid state light source(s) above the lamp base, with the elevating element also being thermally conductive to conduct heat from the light source to the lamp base. The elevating element can comprise many different materials or devices arranged in different ways, with some lamps comprising heat pipe elevating elements. The LED lamps according to the present invention can also include other features to aid in thermal management and to produce the desired emission pattern, such as internal optically transmissive materials and heat sinks with different heat fin arrangements.

One embodiment of a solid state lamp according to the present invention comprises a solid state light source and a lamp base at least partially comprising a heat conductive material. An elongated elevating element is mounted to the lamp with the light source mounted to the elevating element such that the solid state light source is above the lamp base. The elevating element can be made of a material that is at least partially heat conductive. A diffuser is included to diffuse light emitting from lamp into the desired emission pattern, and an optically transmissive material is included in the diffuser.

Another embodiment of a solid state lamp according to the present invention comprises a solid state light source and an elongated elevating element mounted to a lamp base with the light source mounted to the elevating element such that the light source is above the lamp base. The lamp base at least partially comprising a heat conductive material, and further comprises heat fins. At least some of the heat fins extend above the top surface of said lamp base to at least partially surround the elevating elements and LEDs.

Another embodiment of a solid state lamp according to the present invention comprises a thermally conductive elongated elevating element and a solid state light source mounted to the elevating element. A lamp base is included, with the elevating element mounted to the lamp base so that the solid state light source is above the lamp base. An outer enclosure is included that at least partially surrounds the elevating element and the solid state light source. An optically transmissive material is included at least partially filling the outer enclosure.

Still another embodiment of a solid state lamp according to the present invention comprises a solid state light source and an elongated elevating element mounted to a lamp base with the light source mounted to the elevating element. A lamp base at least partially comprising a heat conductive material, and further comprising heat fins, at least some of which widen moving down said lamp base.

These and other further features and advantages of the invention would be apparent to those skilled in the art from the following detailed description, taken together with the following accompanying drawings.

BRIEF DESCRIPTION OF THE DRAWINGS

FIG. 1 shows a sectional view of one embodiment of a related LED lamp;

FIG. 2 shows a sectional view of another embodiment of a related LED lamp;

FIG. 3 shows the size envelope for a standard A19 replacement bulb;

FIG. 4 is a perspective view of one embodiment of an LED lamp according to the present invention;

FIG. 5 is a side elevation view of the LED lamp shown in FIG. 4;

FIG. 6 is a side sectional view of the LED lamp shown in FIG. 4;

FIG. 7 is a perspective view of another embodiment of an LED lamp according to the present invention;

FIG. 8 is perspective view of the LED lamp in FIG. 7, without a diffuser dome;

FIG. 10 is a side sectional view of the LED lamp shown in FIG. 7;

FIG. 12 is a side view of another embodiment of an LED lamp according to the present invention;

FIG. 13 is a side sectional view of another embodiment of an LED lamp according to the present invention;

FIG. 14 is a side sectional view of another embodiment of an LED lamp according to the present invention;

FIG. 15 is a side sectional view of another embodiment of an LED lamp according to the present invention;

FIG. 16 is a side sectional view of another embodiment of an LED lamp according to the present invention;

FIG. 17 is a side sectional view of another embodiment of an LED lamp according to the present invention;

FIG. 18 is a perspective view of another embodiment of an LED lamp according to the present invention;

FIG. 19 is a perspective view of another embodiment of an LED lamp according to the present invention; and FIG. 20 is a side view of another embodiment of an LED lamp according to the present invention.

DETAILED DESCRIPTION OF THE INVENTION

Figure 9:
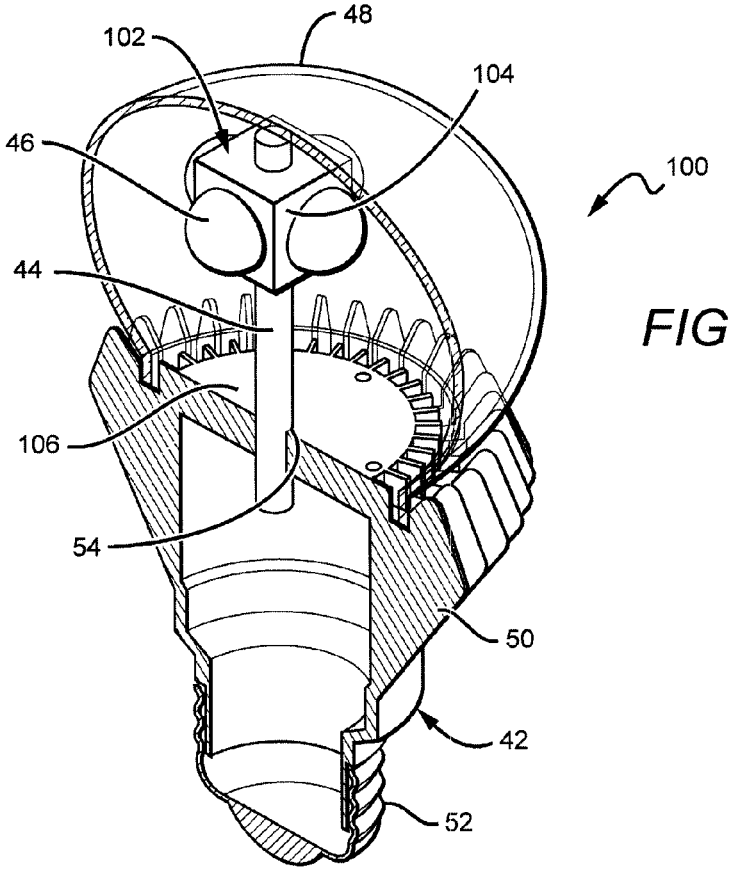
FIG. 9 is a perspective sectional view of the LED lamp shown in FIG. 7.

The present invention is directed to different embodiments of solid state lamp structures that in some embodiments provide elevating elements to mount LED chips or packages ("LEDs") above the lamp base. The elevating elements can comprise many different thermally conductive materials, as well as multiple material devices arranged to conduct heat. In some embodiments, the elements can comprise one or more heat pipes, with the LEDs mounted to the one end of and in thermal contact with the heat pipe. The other end of the heat pipe can be mounted to the lamp base with the heat pipe in an orientation to elevate the LEDs above the base. The heat pipes also conduct heat from the LEDs to the lamp base where the heat can efficiently radiate into the ambient. This arrangement allows for the LEDs to operate at a lower temperature, while allowing the LEDs to remain remote to the lamp base, which can be one of the lamp's primary heat dissipation features. This in turn allows for the LEDs to be driven with a higher drive signal to produce a higher luminous flux. Operating at lower temperatures can provide the additional advantage of improving the LED emission and increase the LED lifespan.

Heat pipes are generally known in the art and are only briefly discussed herein. Heat pipes can comprise a heat-transfer device that combines the principles of both thermal conductivity and phase transition to efficiently manage the transfer of heat between two interfaces. At the hot interface (i.e. interface with LEDs) within a heat pipe, a liquid in contact with a thermally conductive solid surface turns into a vapor by absorbing heat from that surface. The vapor condenses back into a liquid at the cold interface, releasing the latent heat. The liquid then returns to the hot interface through either capillary action or gravity action where it evaporates once more and repeats the cycle. In addition, the internal pressure of the heat pipe can be set or adjusted to facilitate the phase change depending on the demands of the working conditions of the thermally managed system.

A typical heat pipe includes a sealed pipe or tube made of a material with high thermal conductivity, such as copper or aluminum at least at both the hot and cold ends. A vacuum pump can be used to remove air from the empty heat pipe, and the pipe can then be filled with a volume of working fluid (or coolant) chosen to match the operating temperature. Examples of such fluids include water, ethanol, acetone, sodium, or mercury. Due to the partial vacuum that can be near or below the vapor pressure of the fluid, some of the fluid can be in the liquid phase and some will be in the gas phase.

This arrangement of elevating the LEDs on a heat pipe can provide a number of additional advantages beyond those mentioned above. Remote placement of the LEDs on a heat pipe can allow for a concentrated LED light source that more closely resembles a point source. The LEDs can be mounted close to one another on the heat pipe, with little dead space between adjacent LEDs. This can result in a light source where the individual LEDs are less visible and can provide overall lamp emission with enhanced color mixing. By elevating the LED light source, greater angles of light distribution are also available, particularly emission in the down direction (compared to planar source on base). This allows the lamps to produce more omnidirectional emission pattern, with some embodiments comprising an emission pattern with intensity variation of approximately ±20 percent or less. Still other embodiments can comprise an emission pattern having an omnidirectional emission pattern with intensity variation of approximately ±15 percent or less.

In some embodiments the emission patterns can meet the requirements of the ENERGY STAR® Program Requirements for Integral LED Lamps, amended Mar. 22, 2010, herein incorporated by reference. The elevated LEDs along with the relative geometries of the lamp elements can allow light to disperse within 20% of mean value from 0 to 135 degrees with greater than 5% of total luminous flux in the 135 to 180 degree zone (measurement at 0, 45 and 90 azimuth angles). The relative geometries can include the lamp mounting width, height, head dissipation devices width and unique downward chamfered angle. Combined with a diffuser dome, the geometries can allow light to disperse within these stringent ENERGY STAR® requirements.

The present invention can reduce the surface areas needed to dissipate LED and power electronics thermal energy and still allow the lamps to comply with ANSI A19 lamp profiles 30 as shown in FIG. 3. This makes the lamps particularly useful as replacements for conventional incandescent and fluorescent lamps or bulbs, with lamps according to the present invention experiencing the reduced energy consumption and long life provided from their solid state light sources. The lamps according to the present invention can also fit other types of standard size profiles including but not limited to A21 and A23.

Different embodiments can be used with diffuser domes and by concentrating the light source on the heat pipe within the diffuser dome, there can be an increased distance between the light source and the diffuser. This allows for greater color mixing as the light emits from the LEDs and as the light passes through the diffuser dome. LED lamps according to the present invention can also have power supply units that generate heat and are typically located in the lamp base. Elevating of the LEDs above the base on heat pipe separates the heat generating LEDs from the heat generating power supply units. This reduces thermal "cross-talk" between the two and allows for both to operate at lower temperatures. The remote arrangement can also allow for directional positioning of the LEDs on the heat pipe to provide the desired lamp emission pattern. This directional emission can be provided from LEDs mounted to different up and down angled surfaces to provide the desired emission.

In the embodiments utilizing a diffuser, the diffuser not only serves to mask the internal components of the lamp from the view by the lamp user, but can also disperse or redistribute the light from the remote phosphor and/or the lamp's light source into a desired emission pattern. In some embodiments the diffuser can be arranged to assist in disperse light from the LEDs on the heat pipe into a desired omnidirectional emission pattern.

The properties of the diffuser, such as geometry, scattering properties of the scattering layer, surface roughness or smoothness, and spatial distribution of the scattering layer properties may be used to control various lamp properties such as color uniformity and light intensity distribution as a function of viewing angle. By masking the internal lamp features, the diffuser can provide a desired overall lamp appearance when the lamp or bulb is not illuminated.

In some embodiments, The diffuser or other optically transmissive elements can form an enclosure around that fully or partially surrounds the lamp's heat pipe and/or elevated LEDs. The enclosure can be fully or partially filled with an optically transmissive material that can also be thermally conductive. The material can further assist in conducting heat away from the LEDs to dissipate into the ambient, and can also include conversion or scattering material to form the desired emission pattern. In still other embodiments, the enclosure can be arranged with different compartments or envelopes, some of which can have an optically transmissive material. In other embodiments there can be multiple compartments or envelopes holding different materials.

The lamp base can also comprise a heat sink structure with the heat pipe arranged in thermal contact with the heat sink structure. In some embodiments, the heat sink structure can comprise heat dissipating fins to radiate heat from the heat sink structure to the ambient. The fins can be arranged in many different ways, with some embodiments having fins connected primarily to the base of the lamp in alignment with the longitudinal axis of the lamp. In some of these embodiments, some or all of the fins can extend above the lamp base to fully or partially surround the lamp's heat pipe or elevated LEDs. In some embodiments, some or all of the fins can extend around the lamp's elevated LEDs to form a fin structure around the LEDs that resembles a "bird cage" type structure. It is understood that the heat fins of the lamps according to the present invention can be located in many different locations and in many different orientation. In some embodiments, the heat fins can comprise structures connected to the heat pipe or base that widen from the heat pipe or base moving down the LED lamp. This can provide a heat fin arrangement that reduces the amount of LED light that can be blocked by the heat fin structure. The lamp base can also comprise a means for connecting the lamp to a power source, such as a connector to connect to an Edison type socket, etc.

The features of the different lamp embodiments described herein can provide a solid state lamp that produces an emission pattern that more closely matches a traditional incandescent light bulb in form and function. These features also allow for emission with the intensity, temperature and color rendering index (CRI) that also resembles those of a traditional incandescent light bulb. This allows some lamp embodiments having the advantages of a solid state light source, such as LEDs, that are particularly applicable to uses as replacement bulbs for incandescent bulbs.

Lamps have been developed that utilize a larger shaped remote phosphor that can convert some the LED light. These larger phosphors, however, can result in higher material costs for the larger remote phosphor, and an envelope for the lamp. The present invention is arranged such that white emitting LEDs providing the desired CRI and color temperature can be mounted to the heat sink to provide the desired lamp emission. This allows for some lamps according to the present invention to operate without the complexity and expense of a remote phosphor, such as a phosphor globe.

It is understood, however, that other embodiments of LED lamps according to the present invention can be used in combination with a shaped remote phosphor, with the remote phosphor also being mounted to the heat sink. The remote phosphor can take many different shapes, such as a general globe-shape with the heat pipe at least partially arranged within the globe shaped phosphor. This can provide an arrangement with the desired color uniformity by the heat pipe and its emitters providing an approximate point light source within the remote phosphor. Many different remote phosphors are described in U.S. patent application Ser. No. 13/018,245, titled "LED Lamp with Remote Phosphor and Diffuser Configuration", filed on Jan. 31, 2011, which is incorporated herein by reference. In some embodiments, the remote phosphor can comprise an envelope or compartment within the lamp that can hold an optically transmissive and/or thermally conductive material. When used in combination with a diffuser dome, the envelope formed between the remote phosphor and diffuser dome can form an envelope that may or may not have an optically transmissive and/or thermally conductive material.

The present invention is described herein with reference to certain embodiments, but it is understood that the invention can be embodied in many different forms and should not be construed as limited to the embodiments set forth herein. In particular, the present invention is described below in regards to certain lamps or lighting components having LEDs, LED chips or LED components ("LEDs") in different configurations, but it is understood that the present invention can be used for many other lamps having many different configurations. The components can have different shapes and sizes beyond those shown and different numbers of LEDs or LED chips can be included. Many different commercially available LEDs can be used such as those commercially available LEDs from Cree, Inc. These can include, but are not limited to Cree's XLamp® XP-E LEDs or XLamp® XP-G LEDs.

It is also understood that when an element such as a layer, region or substrate is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one layer or another region. It is understood that these terms are intended to encompass different orientations of the device in addition to the orientation depicted in the figures.

Embodiments of the invention are described herein with reference to cross-sectional view illustrations that are schematic illustrations of embodiments of the invention. As such, the actual thickness of the layers can be different, and variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. A region illustrated or described as square or rectangular will typically have rounded or curved features due to normal manufacturing tolerances. Thus, the regions illustrated in the figures are schematic in nature and their shapes are not intended to illustrate the precise shape of a region of a device and are not intended to limit the scope of the invention.

FIGS. 4-6 show one embodiment of a solid state lamp 40 according to the present invention that can comprise a lamp base 42, heat pipe 44 and LEDs 46, with heat pipe 44 mounted vertically to the lamp base 42 and with the LEDs 46 mounted to the end of the heat pipe 44 opposite the lamp base 42. A diffuser dome 48 can also be mounted to the lamp base over the heat pipe 44 and LEDs 46. The lamp base 42 can be arranged in many different ways, with many different features, in the embodiment shown it comprises a heat sink structure 50 and electrical connector 52 for connecting to a source of electrical power. The heat sink structure 50 can at least partially comprise a thermally conductive material, and many different thermally conductive materials can be used including different metals such as copper or aluminum, or metal alloys. Copper can have a thermal conductivity of up to 400 W/m-k or more. In some embodiments the heat sink can comprise high purity aluminum that can have a thermal conductivity at room temperature of approximately 210 W/m-k. In other embodiments the heat sink structure can comprise die cast aluminum having a thermal conductivity of approximately 200 W/m-k.

The heat sink structure 50 can also comprise a smooth outer surface and in other embodiments can comprise other heat dissipation features such as heat fins that increase the surface area of the heat sink to facilitate more efficient dissipation into the ambient. In some embodiments, the heat fins can be made of same material or a material with higher thermal conductivity than the remainder of the heat sink structure. The heat fins have a generally vertical orientation, but it is understood that in other embodiments the fins can have a horizontal or angled orientation, or combinations of different orientations. In still other embodiments, the heat sink can comprise active cooling elements, such as fans, to lower the convective thermal resistance within the lamp.

The lamp base 42 can also comprise different areas of solid heat conducting material and different open areas to house lamp features such as a power supply unit as described below. In some embodiments the portion above the electrical connector 52 can comprise a substantially solid heat conducting material, with some embodiments having heat fins that radiate out from the solid material. The heat pipe 44 can be mounted to the lamp base using many different mounting methods and materials. As best shown in FIG. 6, some lamp embodiments can comprise a countersunk hole 54 in the heat conductive solid portion of the base, with the countersunk hole 54 provided at the desired angle of the heat pipe 44 and in the desired location of the heat pipe. In the embodiment shown, the countersunk hole 54 has a generally vertical orientation and is located in general alignment with the longitudinal axis of the lamp base 42.

The heat pipe 44 can be held in place using many different material and mechanisms, and in the embodiment shown be bonded in countersunk hole 54 using different materials, such as thermally conductive materials that allow heat to spread from the heat pipe 44 to the lamp base 42. One suitable binding material comprises a thermal epoxy, but it is understood that many different thermally conductive materials can be used such as thermally conductive grease. Conventional thermally conductive grease can contain ceramic materials such as beryllium oxide and aluminum nitride or metal particles such as colloidal silver. In one embodiment a thermal grease layer is used having a thickness of approximately 100 μm and thermal conductivity of k=0.2 W/m-k. This arrangement provides an efficient thermally conductive path for conducting heat from the heat pipe 44 to the heat sink structure 50.

It is also understood that the arrangement shown in FIG. 6 is only one of the many mounting arrangements that can be used in LED lamps according to the present invention. In other embodiments the heat pipe 44 can be mounted to the heat sink structure 50 by thermal conductive devices such as by clamping mechanisms, brackets, or screws. These devices can hold the heat pipe tightly to the heat sink structure 50 to maximize thermal conductivity.

The electrical connector 52 is included on the lamp base 42 to allow for the solid state lamp 40 to connect to a source of electricity such as to different electrical receptacles. In some embodiments, such as the one shown in FIGS. 4-6, the lamp base 42 can comprise a feature of the type to fit in and mount to a conventional standard Edison socket, which can comprise a screw-threaded portion which can be screwed into an Edison socket. In other embodiments, it can include a standard plug and the electrical receptacle can be a standard outlet, or can comprise a GU24 base unit, or it can be a clip and the electrical receptacle can be a receptacle which receives and retains the clip (e.g., as used in many fluorescent lights). These are only a few of the options for heat sink structures and receptacles, and other arrangements can also be used that safely deliver electricity from the receptacle to the solid state lamp 40.

As best shown in FIG. 6, the lamps according to the present invention can also comprise an internal power supply unit (or power conversion unit) 55. In the embodiment shown, the internal power supply unit 55 can comprise a driver to allow the lamp to run from an AC line voltage/current and to provide light source dimming capabilities. In some embodiments, the power supply can comprise an offline constant-current LED driver using a non-isolated quasi-resonant flyback topology. The internal power supply unit 55 can fit within the lamp base 42 and in the embodiment shown is generally arranged in the electrical connector 52. In some embodiments the power supply unit 55 can comprise a less than cubic centimeter volume, while in other embodiments it can comprise an approximately 20 cubic centimeter volume. In still other embodiments the power supply unit can be non-dimmable but is low cost. It is understood that the power supply used can have different topology or geometry and can be dimmable as well.

As mentioned above, the LEDs 46 can be mounted to the heat pipe 44 at different locations, with a suitable location being at or near the end of the heat pipe 44 opposite the lamp base 42. The LEDs 46 can be mounted in many different ways, but should be mounted such that there is an efficient thermal path from the LEDs 46 to the heat pipe 44. In some embodiments, the LEDs 46 can be mounted directly to the heat pipe 44 by a thermally conductive material such as a solder. In the embodiment shown, a conductive block 56 of conductive material is provided at or near the top of the heat pipe 44, with the conductive block 56 being in thermal contact with the heat pipe 44. The conductive block 56 can be made of many different thermally conductive materials such as copper, conductive plastic, or aluminum, and can be bonded with a conductive material to provide the efficient conductive path between the conductive block 56 and the heat pipe 44. The conductive block 56 provides planar surfaces that can be compatible with mounting LEDs and LED packages.

The lamps according to the present invention can utilize different numbers of LEDs or LED packages, with the embodiment shown having two LEDs 46 mounted to opposing sides of the conductive block 56. It is understood that other embodiments can have more LEDs, and in some embodiments it may be advantageous to have an LED mounted to the top of the conductive block 56 or on more than two surfaces of the conductive block 56 to provide the desired emission pattern. The conductive block 56 has a cube shape, but it is understood that the conductive block 56 can have different shapes that have more or less side surfaces, or can have surfaces angled in one direction, such as up in the case of a pyramid, or having surfaces angled in both up and down directions, such as in the case of a diamond. It is understood that the block can take many different shapes having different numbers of up or down angled surfaces, with different embodiments having four or more planar surfaces, including the bottom facing surface.

In the embodiment shown the conductive block 56 is arranged to hold two LEDs 46, with each on opposing sides of the block 56. The conductive block 56 is thinner on the uncovered side surfaces to bring the back-to-back LEDs 46 in closer proximity to one another so that the overall light source more closely resembles a point light source. The LEDs are arranged at a height within the diffuser dome to provide the desired lamp emission pattern. By raising the LEDs 46 above the lamp base on the heat pipe 44, the LEDs 46 can directly emit light in the down direction past the lamp base 42. This is best shown by representative light ray 59 shown in FIG. 5. This direct downward emission allows for the lamp 40 to more easily provide a desired omnidirectional lamp emission pattern.

As mentioned above, the diffuser 48 can be arranged to disperse light from the phosphor carrier and LED into the desired lamp emission pattern, and can have many different shapes and sizes. In some embodiments, the diffuser also can be arranged over the phosphor carrier to mask the phosphor carrier when the lamp is not emitting. The diffuser can have materials to give a substantially white appearance to give the bulb a white appearance when the lamp is not emitting.

Many different diffusers with different shapes and attributes can be used with solid state lamp 40 as well as the lamps described below, such as those described in U.S. patent application Ser. No. 13/018,245, which is incorporated by reference above. This patent is titled "LED Lamp With Remote Phosphor and Diffuser Configuration", and was filed on Jan. 31, 2011. The diffuser can also take different shapes, including but not limited to generally asymmetric "squat" as in U.S. patent application Ser. No. 12/901,405, titled "Non-uniform Diffuser to Scatter Light into Uniform Emission Pattern," filed on Oct. 8, 2010, and incorporated herein by reference.

A reflective layer(s) or materials can also be included on surfaces of the heat sink structure 50 and on the heat pipe 44 to reflect light from the LEDs 46. In one embodiment, the top surface 58 of the heat sink structure 50 around the heat pipe 44 can comprise a reflective layer 60 that can be made of many different materials deposited and formed on the heat sink structure using known methods. These reflective layers 60 allow for the optical cavity to effectively recycle photons, and increase the emission efficiency of the lamp. In some embodiments the surfaces can be coated with a material having a reflectivity of approximately 75% or more to the lamp visible wavelengths of light emitted by the LEDs 46, while in other embodiments the material can have a reflectivity of approximately 85% or more to the LED light. In still other embodiments the material can have a reflectivity to the LED light of approximately 95% or more. It is understood that the reflective layer can comprise many different materials and structures including but not limited to reflective metals or multiple layer reflective structures such as distributed Bragg reflectors.

During operation of the solid state lamp 40, an electrical signal from the electrical connector 52 can be conducted to the power supply unit 55, and a drive signal can then be conducted to the LEDs 46 causing them to emit light. The signal from the power supply unit 55 can be conducted to the LEDs 46 using known conductors that can run to the LEDs along the heat pipe 44. In some embodiments a sleeve can be included around the heat pipe in which the conductors can run, with some sleeve embodiments having a reflective surface. In still other embodiments, a drive circuit or drive board (not shown) can be included between the power supply unit and the LEDs 46 to compensate for changes in LED emission over time and at different temperatures. This drive circuit can be in many different locations in the LED lamp 40 such as on the top surface 58 of the heat sink structure 50.

As the LEDs 46 emit light, they generate heat that can be conducted to the conductive block 56, and on to the top portion of the heat pipe 44. The heat pipe 44 then conducts heat to the lamp base 42 and its heat sink structure 50, where the heat can dissipate into the ambient. This provides efficient management of the heat generated by the LEDs 46, and allows for the LEDs to operate at cooler temperatures.

FIGS. 7-10 show another embodiment of an LED lamp 100 according to the present invention that is similar to the solid state lamp 40 shown in FIGS. 4-6, and for the same or similar features the same reference numbers are used with the understanding the description above for these elements applies to this embodiment. The LED lamp 100 can comprise a lamp base 42, heat pipe 44, LEDs 46 and diffuser dome 48. The base 42 also comprises a heat sink structure 50 and electrical connector 52, with the heat sink structure 50 having a countersunk hole for the heat pipe 44. The heat sink structure 50 can also comprise a reflective layer 60 on the heat sink structure's top surface, and the heat pipe can also be covered by a reflective layer.

The LED lamp 100 also comprises a conductive block 102 that can be made of the same materials as conductive block 56 shown in FIGS. 4-6, but has a somewhat different shape and arranged to accommodate different numbers of LEDs, with the embodiment shown accommodating four LEDs 46. The conductive block 102 has four side surfaces 104 that are substantially the same size with each capable of holding one of the LEDs 46. The side surfaces should be sized so that the LEDs 46 are close to one another while still allowing for the necessary electrical connection to the LEDs 46, as well as the desired thermal dissipation of heat away from the LEDs 46 and into the heat pipe. As discussed above, by bringing the LEDs 46 close to one another, the LEDs 46 can more closely approximate a point light source.

The heat sink structure 50 can also comprise heat fins 105 that are aligned with the lamp's longitudinal axis and radiate out from a center heat conductive core 106, with the heat fins 105 increasing the surface area for heat to dissipate. Heat from the heat pipe 44 spreads into the conductive core 106 and then spreads into the heat fins 105, where it spreads into the ambient. The heat fins 105 can take many different shapes and can be arranged in many different ways, with the heat fins 105 arranged vertically on the conductive core 106. The fins angle out and become larger moving up the heat sink structure 50 from the electrical connector 52, and then angle back toward the top of the heat sink structure 50. The lower portion can angle out in a way to allow the LED lamp 100 to fit within a particular lighting size envelope, such as A19 size envelopes. The fins angle back in to allow for light from the LEDs to emit down at the desired angle without being blocked be the heat fins 105.

The top of the heat fins 105 also comprise a slot 108 (best shown in FIG. 8) for holding the bottom edge of the diffuser dome 48. As best shown in FIG. 10, the fins 105 begin at the heat conductive core 106 at a point within the diffuser dome 48 so that a portion of the heat fins 105 are within the bottom edge of the diffuser dome 48. This provides opening between the fins to allow air to pass from the interior of the diffuser dome 48 to along the spaces between the heat fins 105, and vice versa. This allows for heated air to pass from within the diffuser dome, also assisting in keeping the LEDs 46 operating at the desired temperature.

Figure 11:
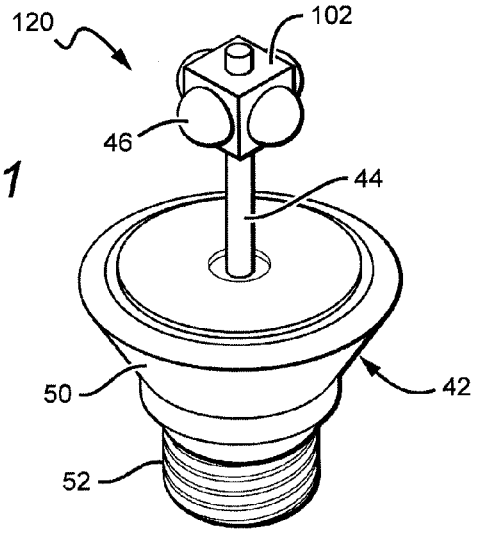
FIG. 11 is a perspective view of another embodiment of an LED lamp according to the present invention.

The different LED lamps according to the present invention can be arranged in many different ways, with many different features. FIG. 11 shows another embodiment of an LED lamp 120 according to the present invention also having base 42, heat pipe 44, and LEDs 46, and is arranged to accommodate a diffuser dome (not shown). In this embodiment, the base comprises a heat sink structure 50 and electrical connector 52 similar to those shown in FIGS. 4-6, but also comprises a conductive block 102 having side surfaces to accommodate four LED chips, as described above with reference to FIGS. 7-10.

FIG. 12 shows still another embodiment of an LED lamp 150 according to the present invention, heat pipe 44, LEDs 46 and diffuser dome (or lens) 48. This embodiment comprises a lamp base 152 having an electrical connector 154 to connect to a source of electrical power. The lamp base 152 further comprises an active cooling element 156 such as a fan that actively moves air around the LED lamp to keep the lamp element at the desired temperature. It is understood that the LED lamp 150 can also comprise a heat sink structure that operates in cooperation with the active cooling element 156, and in some embodiments the heat sink structure can comprise heat fins as described above that allow air flow to the interior of the diffuser dome. Different active cooling LED lamp active cooling elements are described in U.S. patent application Ser. No. 12/985,275, titled "LED Bulb with Integrated Fan Element for Enhanced Convective Heat Dissipation," filed on Jan. 5, 2011, and in U.S. patent application Ser. No. 13/022,490, titled "LED Lamp with Active Cooling Element," filed on Feb. 7, 2011, both of which are incorporated herein by reference.

The LED lamp 150 also comprises a conductive block 158 that is mounted to the top of and in thermal contact with the heat pipe 44. The conductive block 158 is arranged such that its top surface 160 is available for mounting an LED 46. The conductive block 158 can accommodate LEDs 46 on its top surface 160 as well as its side surfaces 162. If each surface held a single LED 46, the block 158 can hold up to five LEDs, but it is understood that each surface can hold more than one LED.

As mentioned above, the heat pipes can be mounted to their lamp base using many different mechanisms and materials. FIG. 13 shows still another embodiment of an LED lamp 170 according to the present invention, having a lamp base 42 and a heat pipe 44. In the embodiment shown in FIGS. 4-6 and described above, the heat pipe was mounted within a longitudinal (vertical) hole using a conductive bonding material. In LED lamp 170, the heat pipe 44 has an angled section 172 mounted within the base. The angled section 172 provides a greater portion of the heat pipe 44 that can be held within the lamp base 42 providing a greater surface area for conducting heat from the heat pipe 44 into the lamp base 42. This can allow for the lamp base 42 to dissipate a higher level of heat from the heat pipe 44. This is only one of the many different shapes that the heat pipe 44 can take in the lamp base 42.

Embodiments of the present invention can be arranged in many different ways beyond those described above. By way of example, FIG. 14 shows another embodiment of an LED lamp 200 according to the present invention that can comprise two heat pipes 202, 204, arranged in the same way as the heat pipes above, with each heat pipe having one or more LEDs 206 mounted on a conductive block 208. Each of the LEDs 206 is also mounted to its respective conductive block such that its emission is directed out from the longitudinal axis of the lamp toward the diffuser dome 210. By having more than one heat pipe, this arrangement may provide enhanced heat dissipation capabilities, and may provide additional flexibility in generating the desired lamp emission pattern. It is also understood that the heat pipes according to the present invention can have many different shapes, sizes and angles, and can be mounted within the lamps in many different ways and locations.

FIG. 15 shows still another embodiment of LED lamp 220 according to the present invention that is similar to LED lamp 40 described above and shown in FIGS. 4-6. The LED lamp 220 can comprise a lamp base 222, heat pipe 224 and LEDs 226, with heat pipe 224 mounted vertically to the lamp base 222. The LEDs 226 can be mounted to the end of the heat pipe 224 opposite the lamp base 222. A diffuser dome or other optically transmissive enclosure 228 can also be mounted to the lamp base 222 over the heat pipe 224 and LEDs 226. In the embodiment shown, a conductive block 230 of conductive material is provided at or near the top of the heat pipe 224, with the conductive block 230 being in thermal contact with the heat pipe 224. The LEDs 226 can then be mounted to the conductive block 230, with heat from the LEDs 226 conducting through the conductive block 230 and into the heat pipe 224. The features of the LED lamp 220 can be made of the same materials and can have the same or similar characteristics to the corresponding features of the solid state lamp 40 described above.

In this embodiment, the LED lamp 220 the diffuser 228 can form an enclosure to hold an optically transmissive material 232 that can aid in the lamp's thermal management and can comprise materials to assist in generating the desired lamp emission pattern. Many different materials can be used, with some embodiments utilizing a liquid, gel, or other material that has moderate to highly thermal conductivity, is moderate to highly convective, or both.

Many different optically transmissive material can be used in the different embodiments according to the present invention, with some being a liquid, gel, or other material that is either moderate to highly thermally conductive, moderate to highly convective, or both, can be used. In some embodiments, the transmissive material can comprise a non-gaseous, formable material. As used herein, a "gel" includes a medium having a solid structure and a liquid permeating the solid structure. A gel can include a liquid, which is a fluid and surrounds the LEDs 226 in the diffuser 228. In other embodiments, the optically transmissive material can have low to moderate thermal expansion, or a thermal expansion that substantially matches that of one or more of the other components of the lamp. The optically transmissive material in at least some embodiments is also inert and does not readily decompose.

In still other embodiments, the optically transmissive material can comprise an oil. The oil can be petroleum-based, such as mineral oil, or can be organic in nature, such as vegetable oil. In still other embodiments the optically transmissive material can comprise perfluorinated polyether (PEPE) liquid, or other fluorinated or halogenated liquid, or gel. An appropriate propylene carbonate liquid or gel having at least some of the above-discussed properties might also be used. Suitable PFPE-based liquids are commercially available, for example, from Solvay Solexis S.p.A. of Italy. In other embodiments where a phase change material is used for the fluid medium, chloromethane, alcohol, methylene chloride or trichloromonofluoromethane can be used. Flourinert™ manufactured by the 3M Company in St. Paul, Minn., U.S.A. can also be used as coolant and/or a phase change material.

In at least some embodiments, the optically transmissive material can have a refractive index that provides for efficient light transfer with minimal reflection and refraction from the LEDs through the enclosure. The material can have the same or a similar refractive index as the material of the enclosure, the LED device package material or the LED's substrate material. In some embodiments, material can have a refractive index that is between the indices of two of these materials. As an example, if unpackaged LEDs are used in a centralized LED array, a fluid with a refractive index between that of the LED substrates and the enclosure and/or inner envelope can be used. LEDs with a transparent substrate can be used so that light passes through the substrate and can be radiated from the light emitting layers of the chips in all directions. If the LED substrate is silicon carbide, the refractive index of the substrates is approximately 2.6. If glass is used for the enclosure or envelope, the glass would typically have a refractive index of approximately 1.5. Thus an optically transmissive material with a refractive index of approximately 2.0-2.1 could be used as the index matching fluid medium. LEDs with a sapphire substrate can also be used with the refractive index of sapphire being approximately 1.7. If glass is again used for the enclosure or envelope, the material medium could have a refractive index of approximately 1.6. It is understood that in different embodiments the optically transmissive material can fully fill the enclosure, while in other embodiments it can partially fill the enclosure.

FIG. 16 shows still another embodiment of LED lamp 240 according to the present invention that is similar to LED lamp 220 described above and shown in FIG. 15. The LED lamp 240 can also comprise a lamp base 222, heat pipe 224 and LEDs 226, with heat pipe 224 mounted vertically to the lamp base 222. The LEDs 226 can be mounted to the end of the heat pipe 224 opposite the lamp base 222. A diffuser dome 228 can also be included along with a conductive block 230 at or near the top of the heat pipe 224. The LEDs 226 can then be mounted to the conductive block 230, with heat from the LEDs 226 conducting through the conductive block and into the heat pipe 224. The features of the lamp 220 can be made of the same materials and can have the same or similar characteristics to the corresponding features of the lamps 220 and 40 described above.

In this embodiment, an internal light transmissive dome or enclosure 242 is included within the diffuser 228, and over the heat pipe 224 and LEDs 226. The internal dome 242 optically transmissive material 244 that can aid in the lamp's thermal management and can comprise materials to assist in generating the desired lamp emission pattern. This arrangement provides a void 246 between the internal dome 242 and the diffuser dome 228 that can be substantially or partially evacuated, be filled with air or an inert gas, or can be filled or partly filed with a fluid medium having characteristics either the same or different from that of the fluid medium inside the inner envelope. It should be noted that a lamp according to the embodiments of the invention may include multiple inner envelopes, which can take the form of spheres, tubes or any other shapes. Any or all of these inner envelopes could provide for index matching to optimize the volume of fluid medium needed for proper operation of the lamp. One or more of these inner envelopes could be diffusive and could be made of gels, silicone, plastic, glass or any other suitable material. It is also understood that in some embodiments the internal dome 242 can also as a remote phosphor carrier, and is coated or impregnated with phosphor to provide remote wavelength conversion.

It should also be noted that in this or any of the embodiments shown here, the optically transmissive enclosure or a portion of the optically transmissive enclosure can be coated or impregnated with phosphor. In the different embodiments described herein, the optically transmissive material and also include phosphor particles disbursed and/or suspended therein to convert LED light passing through the material. This allows for the optically transmissive material assist. In the embodiments having one or more inner envelope, the optically transmissive material in the inner envelopes could include suspended phosphor particles while additional materials in other areas, such as between the inner envelope and the optical enclosure could be substantially free of suspended phosphor, or vice versa. The different embodiments can also comprise scattering particles arranged in the different envelope to help scatter and mix the light emitting from the LED lamp.

Many different LEDs can be used in the lamps according to the present invention, with LED devices that typically include a local phosphor. LED devices can be used with a red phosphor or in the optically transmissive enclosure or inner envelope to create substantially white light, or combined with red emitted LED devices in the array to create substantially white light. Such embodiments can produce light with a CRI of at least 70, at least 80, at least 90, or at least 95. By use of the term substantially white light, one could be referring to a chromacity diagram including a blackbody locus of points, where the point for the source falls within four, six or ten MacAdam ellipses of any point in the blackbody locus of points.

A lighting system using the combination of blues shifted yellow (BSY) and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a BSY light from light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially white light can be found in issued U.S. Pat. No. 7,213,940, which is incorporated herein by reference.

The present invention can be arranged in many different ways and with many different features beyond those described above. Some additional embodiments can comprise heat sinks arranged in different ways to further assist in thermal management. FIG. 17 shows another embodiment of an LED lamp 260 according to the present invention that is similar to LED lamps 220 and 240 described above and shown in FIGS. 15 and 16, respectively. The lamp 260 can also comprise a lamp base 222, heat pipe 224 and LEDs 226, with heat pipe 224 mounted vertically to the lamp base 222. The LEDs 226 can be mounted to a conductive block 230 at the end of the heat pipe 224 opposite the lamp base 222. A diffuser dome 228 can also be mounted to the lamp base over the heat pipe 224 and LEDs 226. In this embodiment, the lamp base comprises heat fins 262 similar to those described above but in this embodiment the heat fins 262 that extend up the diffuser dome diffuser dome 228 to a point approximately midway up the diffuser dome 228. The allows for the heat fins to form a cup-like structure around said heat pipe 224 and LEDs 226 The heat fins 262 can be made of a thermally conductive material and provide a greater surface area for dissipating heat. In some embodiments, heat from the LEDs 226 not only passes through the heat pipe 224, but the heat can also radiate through the diffuser dome 228. The heat fins 262 can draw heat away from the diffuser dome 228, spread the heat, and radiate it into the ambient.

This is just one example of the many ways that heat fins can be arranged according to the present invention. In other embodiments the heat fins can extend a longer or shorter distance up the diffuser dome. In still other embodiments, the heat fins can have different lengths. In one such embodiment, the heat fins can have alternating longer and shorter heat fins. The heat fins 262 can be made of many different thermally conductive materials such as aluminum, copper, other metals, or combinations thereof. The fins 262 can be oriented in relation to the LEDs 226 to minimize the blocking of light emitting from the LEDs 226. For example, the heat fin can be oriented generally orthogonal to the LEDs 226 to minimize the cross-section of the heat fins seen by the LEDs 226. The heat fins 226 can also be coated with a white or reflective material to minimize absorption of light that encounters the heat fins 226.

FIG. 18 shows still another embodiment of a LED lamp 280 that can also comprise a lamp base 222, heat pipe 224 and LEDs 226, with heat pipe 224 mounted vertically to the lamp base 222. The LEDs 226 can be mounted to the end of the heat pipe 224 opposite the lamp base 222. Like the embodiments above, a conductive block 230 is provided at or near the top of the heat pipe 224, with the conductive block 230 being in thermal contact with the heat pipe 224. The LED lamp 280 also comprises heat fins 282 that are aligned with the lamp's longitudinal axis and in this embodiment extend up from the lamp base 222 and above the LEDs 226. The heat fins 282 form a "bird cage" around the LEDs 226. Bird cage structures used in LED lamps are generally described in U.S. patent application Ser. No. 13/022,142, titled "Lighting Device With Heat Dissipation Elements," filed on Feb. 7, 2011, and which is incorporated herein by reference.

and serve multiple purposes. The heat fins 282 can form a mechanical barrier to coming in contact with the LEDs to not only protect the LEDs from damage, but also to protect against burns that could occur of a user can in contact with the LEDs 226.

The heat fins 282 can also be made of a thermally conductive material such as those describe above, so that heat from the LEDs 226 conducts into the heat fins 282 and radiates into the lamp base 222 or the ambient. The heat fins 282 can be aligned with the LEDs 226 to minimize the cross-section seen be the LEDs 226, which in turn can minimize the light from the LEDs 226 that might be blocked by the heat fins 282. Like the embodiment above, the heat fins can also be covered with a white or reflective material to minimize absorption of LED light. The heat fins can also comprise axial elements 284, 286 that provide support to hold the heat fins in the desired location.

Bird cage heat fins can be arranged in many different ways in different embodiments according to the present invention. In some embodiments the heat fins can be different shapes or different lengths, and can cover different areas particularly in those areas where blocking of light is to be minimized. FIG. 19 shows still another embodiment of an LED lamp 300 according to the present invention that is similar to the LED lamp 280 in FIG. 18, and also comprises heat fins 302 in a bird cage arrangement around the heat pipe 224 and the LEDs 226. Axial elements 304, 306 are included to support the heat fins 302. In this embodiment, however, alternating heat fins do not extend past axial element 304. This results in fewer heat fins 302 in the area above axial element 304, and reduced blocking of light in that area. This is only one of the many different alternative heat fin arrangements according to the present invention.

Different embodiments can also have LEDs, conductive blocks and heat pipes arranged in many different ways. In the embodiments shown in FIGS. 18 and 19, the conductive block 230 is generally square shaped with four LEDs 226 mounted on the block's side surfaces and facing out. A fifth LED 226 is also mounted on the block's top surface. The conductive block 230 can have many different shapes, including hexagon and octagon, with the LEDs 226 mounted on the surfaces in different orientations. Other embodiments can have multiple heat pipe arrangements as discussed above, or can have heat pipes in different shapes or with multiple branches. On one such arrangement, the heat pipe can have a Y-shape with LEDs at the ends of each branch. LEDs can be mounted directly to the heat pipe or can have conductive blocks as described above mounted in different locations such as at the end of the branches.

It is understood that the bird cage embodiments described above can also be used with diffuser domes or remote phosphors as described above. The diffuser can be inside or outside the bird cage in different embodiments and in other embodiments diffusers can be utilized that cover less than the entire bird cage. It is also understood that these embodiments can be used with optically transmissive material 232 that can aid in the lamp's thermal management and can comprise materials to assist in generating the desired lamp emission pattern.

FIG. 20 shows still another embodiment of an LED lamp 320 with an alternative heat sink design. This embodiment also comprises and LED lamp base 222, heat pipe 224 and LEDs 226, with heat pipe 224 mounted vertically to the lamp base 222. The lamp can also comprise a diffuser dome 322 surrounding the heat pipe and the LEDs, with some embodiments arranged to hold an optically transmissive material as described above. The lamp base 222 also comprises heat fins 324 to assist radiating heat from the lamp base 222. In this embodiment, the heat fins 324 are narrowest near the heat pipe and diffuser dome, and then widen moving further down the lamp. This heat fin shape can help minimize the amount of down emitting light that encounters the heat fins, thereby reducing the amount of light that is blocked by the heat fins. This in turn can result in a more uniform and omnidirectional emission pattern for the LED lamp.

Although the present invention has been described in detail with reference to certain preferred configurations thereof, other versions are possible. Therefore, the spirit and scope of the invention should not be limited to the versions described above.

We claim:

1. A solid state lamp, comprising:

a solid state light source;

a lamp base at least partially comprising a heat conductive material;

an elongated elevating element mounted to said lamp base with said light source mounted to said elevating element such that said solid state light source is above said lamp base, said elevating element being at least partially heat conductive;

a diffuser to diffuse light emitting from said lamp into a desired emission pattern, and an optically transmissive material in said diffuser, wherein said optically transmissive material is thermally conductive.

2. The lamp of claim 1, wherein said optically transmissive material conducts heat from said solid state light source to the ambient.

3. The lamp of claim 1, wherein said optically transmissive material comprises one or more conversion materials.

4. The lamp of claim 1, wherein said optically transmissive material comprises scattering particles.

5. The lamp of claim 1, further comprising an internal light transmissive enclosure forming an inner envelope within said diffuser.

6. The lamp of claim 5, wherein said optically transmissive material is within said inner envelope.

7. The lamp of claim 1, wherein said solid state light source comprises a plurality of light emitting diodes (LEDs).

8. The lamp of claim 1, wherein said solid state light source comprises a plurality of LEDs, each of which is emitting in a different direction.

9. The lamp of claim 1, wherein said elevating element comprises a heat pipe.

10. The lamp of claim 1, wherein said light source comprises one or more LEDs.

11. The lamp of claim 1, wherein said light sources are in thermal contact with said elevating element, and said elevating element is in thermal contact with said lamp base.

12. The lamp of claim 1, comprising a thermally conductive path from said light source, through said elevating element, to said lamp base and to the ambient.

13. The lamp of claim 1, wherein said emission pattern is omnidirectional.

14. The lamp of claim 1, wherein said lamp base comprises a heat sink.

15. The lamp of claim 14, wherein said lamp base comprises heat fins.

16. The lamp of claim 15, wherein at least some of said heat fins extend from said lamp base to at least partially surround said elevating element and/or said solid state light source.

17. The lamp of claim 15, wherein said heat fins extend along the surface of said diffuser.

18. The lamp of claim 15, wherein said heat fins comprise a bird cage structure around said elevating element and/or said solid state light source.

19. The lamp of claim 15, wherein said heat fins widen moving down said lamp base away from said light source.

20. The lamp of claim 15, wherein said heat fins widen moving down said lamp.

21. The lamp of claim 1, wherein said lamp base comprises an electrical connector and/or a power supply unit.

22. The lamp of claim 1, wherein said light source is mounted to said elevating element with the other end of said elevating element mounted to said lamp base.

23. The lamp of claim 1, further comprising a conductive block mounted to and in thermal contact with said elevating element, said light source mounted to said conductive block.

24. The lamp of claim 23, wherein said solid state light source comprises a plurality of LEDs, with at least some of said LEDs mounted on different surfaces of said conductive block.

25. The lamp of claim 1, wherein said emission pattern comprises intensity variation of approximately +20 percent or less.

26. The lamp of claim 1, wherein said emission pattern comprises an intensity variation of approximately +15 percent or less.

27. The lamp of claim 1, wherein said elongating element comprises more than one heat pipe.

28. The lamp of claim 1, wherein said emission pattern comprises intensity variation of approximately +20 percent or less.

29. A solid state lamp, comprising:

a solid state light source;

an elongated elevating element mounted to a lamp base with said light source mounted to said elevating element such that said light source is above said lamp base, said elevating element being at least partially heat conductive;

a lamp base at least partially comprising a heat conductive material, said lamp base further comprising heat fins, at least some of which extend above the top surface of said lamp base to at least partially surround said elevating elements and said light source.

30. The lamp of claim 29, wherein said fins form a bird cage structure around said light source.

31. The lamp of claim 30, wherein said heat fins extend different distances above the top surface of said lamp base.

32. The lamp of claim 29, wherein said heat fins extend above said lamp base to form a cup-like structure around said elevating element and said light source.

33. The lamp of claim 29, further comprising an optically transparent enclosure holding an optically transmissive material.

34. The lamp of claim 33, wherein said optically transmissive material is thermally conductive.

35. The lamp of claim 33, wherein said optically transmissive material comprises one or more conversion materials.

36. The lamp of claim 33, wherein said optically transmissive material comprises scattering particles.

37. The lamp of claim 33, further comprising an internal light transmissive enclosure forming an inner envelope within said optically transparent enclosure.

38. The lamp of claim 37, wherein said optically transmissive material is within said inner envelope.

39. The lamp of claim 33, wherein said elevating element comprises a heat pipe.

40. The lamp of claim 29, wherein said light sources are in thermal contact with said elevating element, and said elevating element is in thermal contact with said lamp base.

41. The lamp of claim 29, further comprising a conductive block mounted to and in thermal contact with said elevating element, said light source mounted to said conductive block.

42. A solid state lamp, comprising:

a thermally conductive elongated elevating element and a solid state light source mounted to said elevating element;

a lamp base, said elevating element mounted to said lamp base such that said solid state light source is above said lamp base;

an outer enclosure at least partially surrounding said elevating element and said solid state light source; and an optically transmissive material at least partially filling said outer enclosure, wherein said optically transmissive material is thermally conductive.

43. The lamp of claim 42, wherein said optically transmissive material conducts heat from said solid state light source to said ambient.

44. The lamp of claim 42, wherein said optically transmissive material comprises one or more conversion materials.

45. The lamp of claim 42, wherein said optically transmissive material comprises scattering particles.

46. The lamp of claim 42, further comprising an internal enclosure forming an inner envelope within said outer enclosure.

47. The lamp of claim 46, wherein said optically transmissive material is within said inner envelope.

48. The lamp of claim 42, wherein said lamp base comprises heat fins.

49. The lamp of claim 48, wherein at least some of said heat fins extend from said lamp base to at least partially surround said elevating element and/or said solid state light source.

50. The lamp of claim 48, wherein said heat fins extend along the surface of said outer enclosure.

51. The lamp of claim 48, wherein said heat fins comprise a bird cage structure around said elevating element and/or said solid state light source.

52. A solid state lamp, comprising:

a solid state light source;

an elongated elevating element mounted to said lamp with said light source mounted to said elevating element, said elevating element being at least partially heat conductive;

a lamp base at least partially comprising a heat conductive material, said lamp base further comprising heat fins, at least some of which widen moving down said lamp base.

53. The lamp of claim 52, further comprising an outer enclosure at least partially surrounding said elevating element and said solid state light source, and an optically transmissive material at least partially filling said outer enclosure.

54. The lamp of claim 53, wherein said optically transmissive material is thermally conductive.

55. The lamp of claim 53, wherein said optically transmissive material conducts heat from said solid state light source to the ambient.

56. The lamp of claim 53, wherein said optically transmissive material comprises one or more conversion materials.

57. The lamp of claim 53, further comprising an internal enclosure forming an inner envelope within said outer enclosure.

58. The lamp of claim 53, wherein said optically transmissive material is within said inner envelope.

* * * * *